US012214980B2

(12) United States Patent
Yamasaki

(10) Patent No.: US 12,214,980 B2
(45) Date of Patent: Feb. 4, 2025

(54) DOCUMENT CONVEYING APPARATUS, IMAGE READING APPARATUS AND IMAGE FORMING APPARATUS

(71) Applicant: CANON KABUSHIKI KAISHA, Tokyo (JP)

(72) Inventor: Shogo Yamasaki, Chiba (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 123 days.

(21) Appl. No.: 18/307,984

(22) Filed: Apr. 27, 2023

(65) Prior Publication Data

US 2024/0076154 A1 Mar. 7, 2024

(30) Foreign Application Priority Data

May 10, 2022 (JP) ..... 2022-077459

(51) Int. Cl.
*B65H 1/04* (2006.01)
*B65H 9/00* (2006.01)
(Continued)

(52) U.S. Cl.
CPC ..... *B65H 1/04* (2013.01); *B65H 9/004* (2013.01); *B65H 11/002* (2013.01); *B65H 31/02* (2013.01); *B65H 2405/1116* (2013.01); *B65H 2405/11164* (2013.01); *B65H 2405/1122* (2013.01); *B65H 2405/115* (2013.01); *B65H 2405/321* (2013.01); *B65H 2405/324* (2013.01); *B65H 2405/3322* (2013.01); *B65H 2511/12* (2013.01);
(Continued)

(58) Field of Classification Search
CPC .... B65H 2405/1144; B65H 2405/1116; B65H 2405/1122; B65H 2405/1142; B65H 2405/114; B65H 2511/12; B65H 1/08; B65H 1/12; B65H 1/14; B65H 2405/1117; B65H 1/04; B65H 2405/115; B65H 2801/06; B65H 11/002; B65H 9/004; B65H 2405/321
USPC ..... 271/171
See application file for complete search history.

(56) References Cited

U.S. PATENT DOCUMENTS 11,691,834 B2 * 7/2023 Yamasaki ..... B65H 1/04 270/1.01
12,103,815 B2 * 10/2024 Yamasaki ..... G03G 15/6529

FOREIGN PATENT DOCUMENTS

JP 2005015079 A 1/2005
JP 2016210611 A * 12/2016

* cited by examiner

*Primary Examiner* — Jeremy R Severson
(74) *Attorney, Agent, or Firm* — ROSSI, KIMMS & McDOWELL LLP

(57) ABSTRACT

A document conveying apparatus is provided with a document tray and a discharge tray disposed below the document tray. The document tray includes an upper tray member, a lower tray member, a movable tray member, and a driving portion configured to move the upper tray member and the movable tray member integrally to a raised position and a lowered position. The movable tray member is configured to be moved in a width direction between a first position and a second position in which the movable tray member is retracted into below the upper tray member. The document tray includes a shutter configured to cover a gap created between the upper tray member and the lower tray member. The gap is created by the upper tray member and the movable tray member being moved to the raised position and the movable tray member being moved to the second position.

15 Claims, 19 Drawing Sheets

(51) Int. Cl.
*B65H 11/00* (2006.01)
*B65H 31/02* (2006.01)

(52) U.S. Cl.
CPC ..... *B65H 2511/20* (2013.01); *B65H 2801/06* (2013.01); *B65H 2801/39* (2013.01)

DOCUMENT CONVEYING APPARATUS, IMAGE READING APPARATUS AND IMAGE FORMING APPARATUS

BACKGROUND OF THE DISCLOSURE

Field of the Disclosure

The present disclosure relates to a document conveying apparatus, an image reading apparatus, and an image forming apparatus.

Description of the Related Art

Conventionally, in an image forming apparatus such as a copying machine, a facsimile machine, and a digital multifunction peripheral provided with an image reading apparatus, a document conveying apparatus is widely used to convey documents stacked on a document tray to the image reading apparatus and to discharge the documents read by the image reading apparatus to a discharge tray. Japanese Patent Application Laid-Open No. 2016-210611 discloses a document conveying apparatus in which a discharge tray is disposed below a document tray. The document tray of the Japanese Patent Application Laid-Open No. 2016-210611 is provided with a movable tray member movable in a width direction orthogonal to a feeding direction of the document. In a case in which a large-size document is placed on the document tray, the movable tray member is pulled out and the large-size document is placed on the document tray and the movable tray member. In a case in which a small-size document is placed on the document tray, the movable tray member is retracted into the document tray and the small-size document is placed on the document tray. Since the movable tray member is retracted into the document tray, the visibility of the small-size document discharged onto the discharge tray is improved.

On the other hand, in a case in which the number of documents stacked on the document tray is small, a document conveyance may become unstable depending on a type of the documents. Japanese Patent Application Laid-Open No. 2005-015079 discloses a conveying apparatus configured to convey a recording medium to an image forming portion. The conveying apparatus stably conveys the recording medium to the image forming portion regardless of the number of the recording medium by press-contacting the recording medium stacked on a lift panel to a feeding member.

By the way, in a case in which foreign matter enters inside a document tray, it leads to failure of a member such as a lift panel disposed inside the document tray. However, in the configuration in which a portion of the document tray is moved as described above, a gap is created in the document tray. Then, there is a disadvantage that foreign matter may enter the inside of the document tray through the gap created in the document tray.

SUMMARY OF THE DISCLOSURE

According to an aspect of the present disclosure, a document conveying apparatus comprises: a document tray on which a document is placed; a feeding member configured to feed the document placed on the document tray in a feeding direction; a conveying portion configured to convey the document fed by the feeding member; and a discharge tray which is disposed below the document tray and onto which the document conveyed by the conveying portion is discharged, wherein the document tray includes an upper tray member configured to support the document, a lower tray member disposed to cover an underside of the upper tray member, a movable tray member configured to move, with respect to the upper tray member, in a width direction orthogonal to the feeding direction between a first position in which the movable tray member supports the document together with the upper tray member and a second position in which the movable tray member is retracted from the first position into below the upper tray member, a first regulating member provided on the movable tray member and configured to regulate one side edge of the document supported by the document tray in the width direction, a second regulating member provided on the upper tray member and configured to regulate the other side edge of the document supported by the document tray in the width direction, and a driving portion configured to move the upper tray member and the movable tray member integrally to a raised position in which the document placed on the document tray contacts the feeding member and a lowered position in which the document placed on the document tray is separated from the feeding member, wherein the document tray includes a shutter configured to cover a gap created between the upper tray member and the lower tray member, the gap being created by the upper tray member and the movable tray member being moved from the lowered position to the raised position and the movable tray member being moved from the first position to the second position.

Further features of the present disclosure will become apparent from the following description of exemplary embodiments with reference to the attached drawings.

DESCRIPTION OF THE EMBODIMENTS

The embodiments of the present disclosure will be described below with reference to the drawings.

First Embodiment (Image Forming Apparatus)

Figure 1:
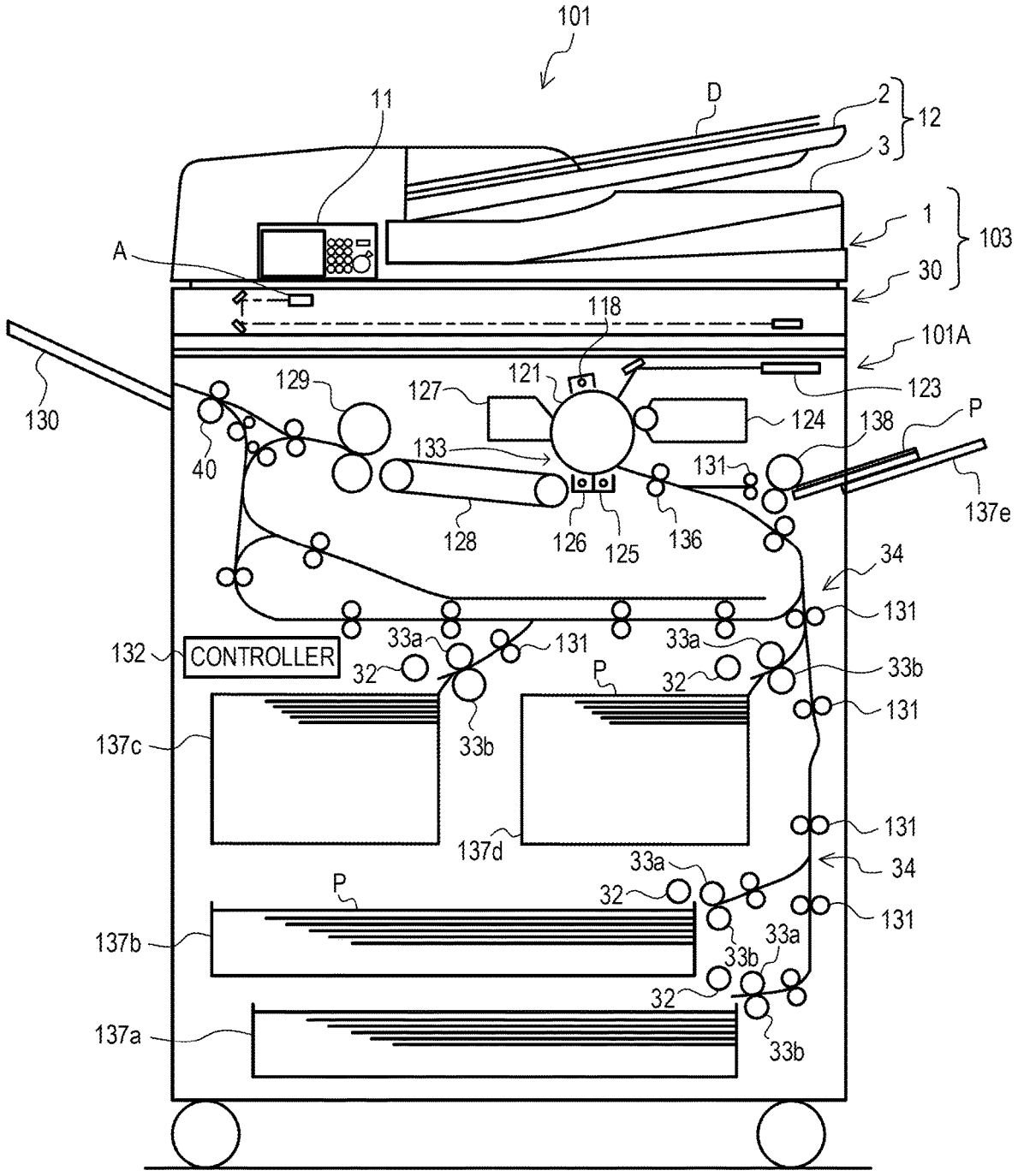
FIG. 1 is a cross-sectional view of an image forming apparatus.

An image forming apparatus 101 configured to form an image on a recording medium P will be described with reference to FIG. 1. FIG. 1 is a cross-sectional view of the image forming apparatus 101. In the following description, a position facing an operation portion 11 with which a user performs various inputs/settings to the image forming apparatus 101 is referred to as a "front side" of the image forming apparatus 101, and a position opposite to the position on the front side is referred to as a "rear side." FIG. 1 shows an internal structure of the image forming apparatus 101 as seen from the front side. In the following description, as an example of the image forming apparatus 101, a copying machine that reads an image of a document and forms the image on a recording medium P using an electrophotographic method will be described. However, the image forming apparatus 101 is not limited to the electrophotographic copying machine, and may be a facsimile, a printer, a color copying machine, or a multifunction peripheral thereof, or may be an image forming apparatus that forms an image on a recording medium P using an inkjet method.

As shown in FIG. 1, the image forming apparatus 101 is provided with an image forming apparatus main body 101A and an image reading apparatus 103 provided on an upper portion of the image forming apparatus main body 101A. The image reading apparatus 103 as an example of a sheet processing apparatus is provided with an automatic document feeder (document conveying apparatus) 1 and a scanner portion 30. The scanner portion 30 is provided with an image reading portion A as an example of a processing portion. The automatic document feeder 1 automatically feeds a document (sheet) D placed on a document tray 2 to the image reading portion A of the scanner portion 30 and discharges the document D read by the image reading portion A to a discharge tray 3. The document tray 2 and the discharge tray 3 constitute a document stacking device 12 on which documents are stacked. The documents D to be fed to the image reading portion (processing portion) A are stacked on the document tray 2. The discharge tray 3 is disposed below the document tray 2. When viewed from above, the document tray 2 and the discharge tray 3 overlap at least partially.

The image reading portion A receives a reflected light of a light irradiated on the document D conveyed to an image reading position and converts an amount of received light into an electrical signal to read an image of the document D optically. Image data (image reading information) is generated based on the electrical signal of the image reading portion A. The image data is input to a controller 132 provided in the image forming apparatus main body 101A. The controller 132 controls the image forming apparatus 101.

The image forming apparatus main body 101A includes an image forming portion 133 configured to form a toner image on a recording medium P using the electrophotographic method and a recording medium conveying portion 34 configured to convey the recording medium P to the image forming portion 133. The image forming portion 133 has a photosensitive drum 121 rotatable along a conveying direction of the recording medium P. A charger 118, an exposure device 123, a developing device 124, a transfer charger 125, a separation charger 126, and a cleaner 127 are disposed around the photosensitive drum 121. The charger 118 uniformly charges a surface of the photosensitive drum 121 which is rotating. The exposure device 123 forms an electrostatic latent image on the surface of the photosensitive drum 121 based on the image data from the image reading apparatus 103. The developing device 124 develops the electrostatic latent image into a toner image with toner (developer).

The image forming apparatus main body 101A is provided with recording medium stacking portions 137*a*, 137*b*, 137*c*, and 137*d* in which various sizes of recording media P are stored. The recording media P stored in the recording medium stacking portions 137*a* to 137*d* are fed out one by one by the corresponding feeding rollers 32, respectively, and delivered to the corresponding conveying rollers 33*a* and separation rollers 33*b*. A manual feed tray 137*e* on which the recording media P are stacked is provided on a right side of the image forming apparatus main body 101A. The recording medium P stacked on the manual feed tray 137*e* is fed by a pair of separation feeding rollers 138. The recording medium P fed from any of the recording medium stacking portions 137*a* to 137*d* or the manual feed tray 137*e* is fed by a pair of conveying rollers 131 to a pair of registration rollers 136.

The pair of registration rollers 136 corrects a skew feed of the recording medium P. The pair of registration rollers 136 conveys the recording medium P to a transfer position so that a leading edge of the recording medium P coincides with a leading edge of the toner image on the photosensitive drum 121 at the transfer position between the photosensitive drum 121 and the transfer charger 125. The transfer charger 125 transfers the toner image on the photosensitive drum 121 to the recording medium P. The separation charger 126 separates the recording medium P from the photosensitive drum 121. The cleaner 127 removes toner remaining on the surface of the photosensitive drum 121 after transferring the toner image to the recording medium P.

The recording medium P onto which the toner image has been transferred is conveyed to a fixing portion 129 by a belt conveying portion 128. The fixing portion 129 heats and pressurizes the recording medium P to fix the toner image to a surface of the recording medium P so that the image is formed on the recording medium P. The recording medium P on which the image is formed is discharged to a discharge tray 130 outside the image forming apparatus main body 101A by a pair of discharge rollers 40.

(Image Reading Apparatus)

Figure 2:
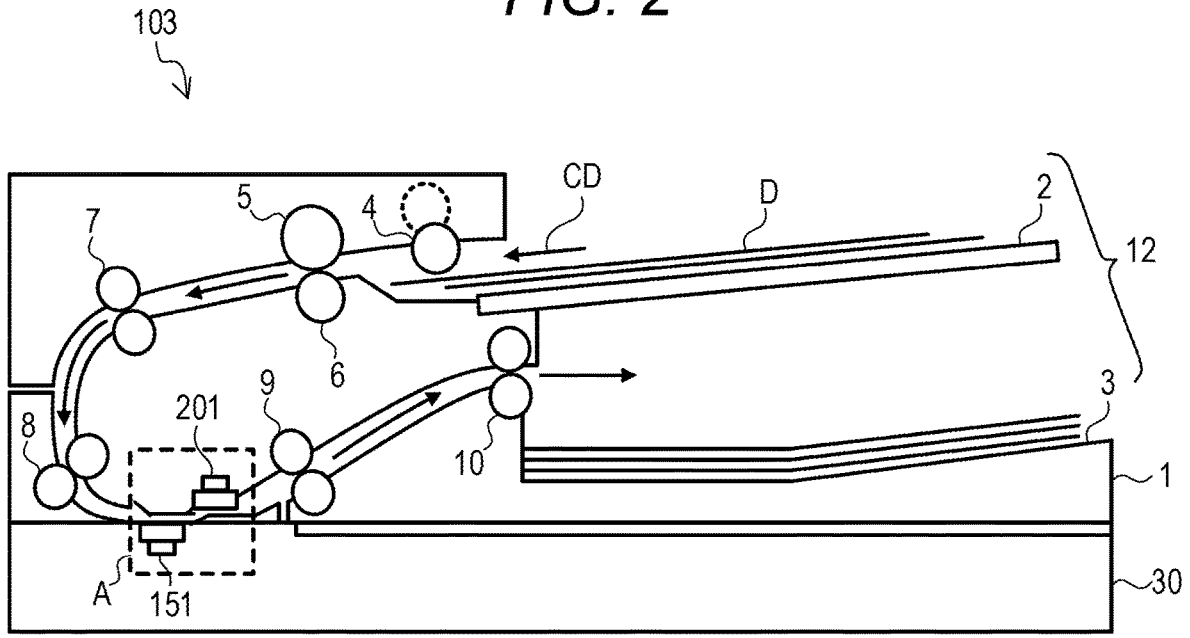
FIG. 2 is a cross-sectional view of an image reading apparatus.

Next, the image reading apparatus 103 as an example of a document processing apparatus will be described with reference to FIG. 2. FIG. 2 is a cross-sectional view of the image reading apparatus 103. The image reading apparatus 103 is disposed on the upper portion of the image forming apparatus 101. However, the image reading apparatus 103 may be configured as a single unit, such as a flatbed scanner with the automatic document feeder 1. It should be noted that the dimensions, materials, shapes, and relative arrangements of the components described in the following descriptions are not intended to limit the scope of the disclosure to them only, unless otherwise specified.

A feeding portion of the automatic document feeder 1 is provided with a feeding roller (feeding member) 4, a feeding roller 5, and a separation roller 6 urged against the feeding roller 5 by a spring. The feeding roller 4 is lowered from the dotted position to the solid position as shown in FIG. 2, contacts the document D placed on the document tray 2, and conveys the document D to an inlet side conveyance path space of the feeding portion in a feeding direction CD. In the feeding portion, the document D conveyed to the feeding roller 5 by the feeding roller 4 is separated one by one by a friction force between the feeding roller 5 and the separation roller 6. The separated document D is conveyed by the feeding roller 5 so that a leading edge of the document D abuts against a pair of registration rollers 7 which has stopped rotating. Since the document D continues to be conveyed by the feeding roller 5 while the pair of registration rollers 7 has stopped, a loop is formed in the document D to correct the skew feed of the document D. When the rotation of the pair of registration rollers 7 is started, the document D of which the skew feed is corrected is conveyed to a pair of conveying rollers 8 by the pair of registration rollers 7. The document D is conveyed to the image reading portion A by the pair of conveying rollers 8. The image reading portion A has a front surface line sensor 151 configured to read an image on a front surface of the document D and a back surface line sensor 201 configured to read an image on a back surface of the document D. While the images on both surfaces of the document D are read by the front surface line sensor 151 and the back surface line sensor 201, the document D is conveyed by a pair of conveying rollers 9 to a pair of discharge rollers (discharge member) 10. The pair of discharge rollers 10 sequentially discharges the document D to stack it on a document stacking surface of the discharge tray 3. In the embodiment, the pair of registration rollers 7, the pair of conveying rollers 8, and the pair of conveying rollers 9 constitute a conveying portion.

Figure 3:
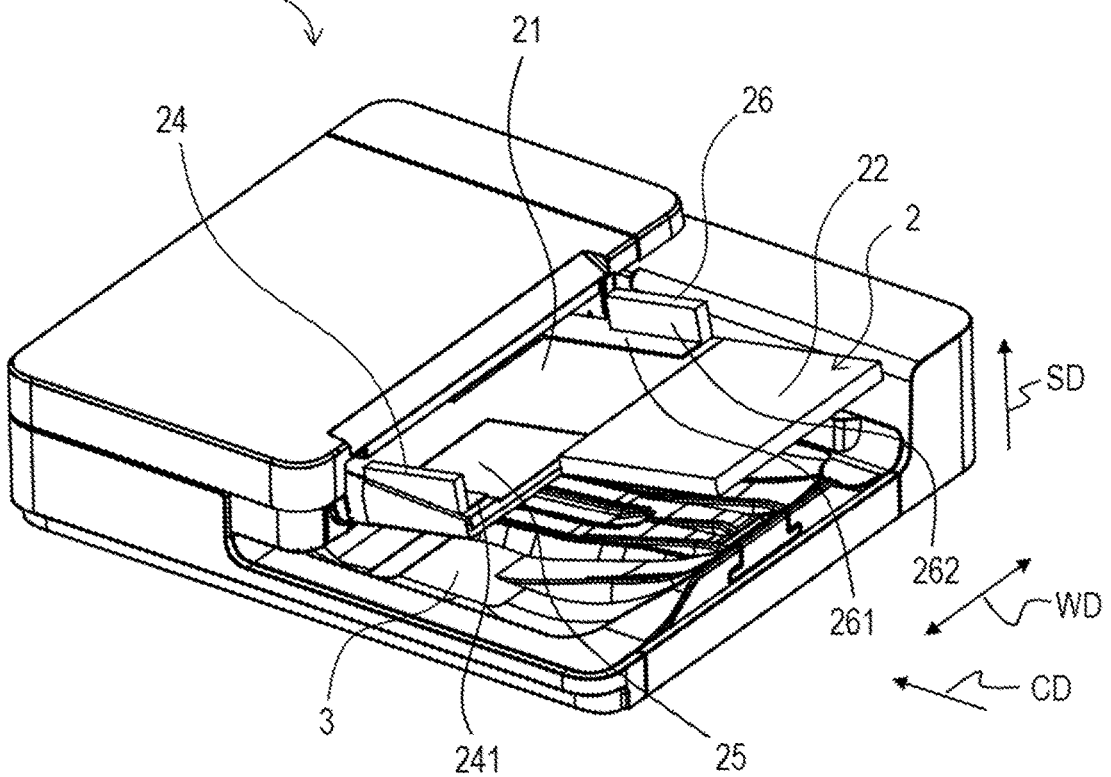
FIG. 3 is a perspective view of an automatic document feeder as seen from a right oblique front side.
Figure 4:
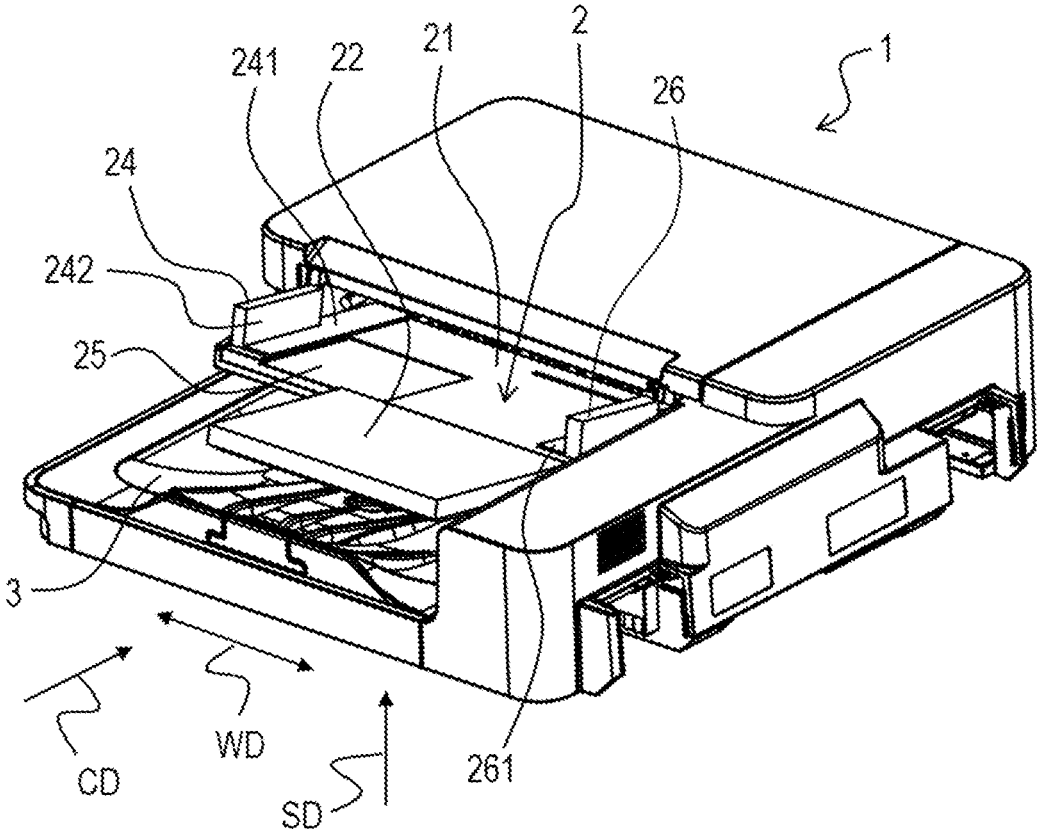
FIG. 4 is a perspective view of the automatic document feeder as seen from a right oblique rear side.

FIG. 3 is a perspective view of the automatic document feeder 1 as seen from a right oblique front side. FIG. 4 is a perspective view of the automatic document feeder 1 as seen from a right oblique rear side. The document tray 2 is provided with a front side regulation guide (first regulating member) 24 configured to regulate one side edge of the document in a width direction WD orthogonal to the feeding direction CD and a rear side regulation guide (second regulating member) 26 configured to regulate the other side edge opposite to the one side edge of the document. The document tray 2 is provided with a first upper document tray 21, a second upper document tray 22, and a telescopic tray (movable tray member) 25. The first upper document tray 21 and the second upper document tray 22 construct an upper tray member configured to support a lower surface of the document to be placed on the document tray 2. In the embodiment, a rear side regulation guide 26 is provided on the first upper document tray 21. A front side regulation guide 24 is provided on the telescopic tray 25. The rear side regulation guide 26 and the front side regulation guide 24 are configured to be movable in conjunction with each other in the width direction WD with respect to the document tray 2.

The rear side regulation guide 26 is provided with a rear side stacking surface 261 configured to support a lower surface of the other side edge of the document in a stacking direction SD of the documents and a rear side regulating surface 262 configured to regulate the other side edge of the document in the width direction WD. The front side regulation guide 24 is provided with a front side stacking surface 241 configured to support a lower surface of the one side edge of the document in the stacking direction SD of the documents and a front side regulating surface 242 configured to regulate the one side edge of the document in the width direction WD. The document tray 2 supports the documents in the stacking direction SD by stacking the documents on the rear side stacking surface 261 provided on the rear side regulation guide 26, the front side stacking surface 241 provided on the front side regulation guide 24, the telescopic tray 25, the first upper document tray 21, and the second upper document tray 22. The documents stacked on the document tray 2 are aligned in the width direction WD and both edges of the documents are regulated by the rear side regulating surface 262 provided on the rear side regulation guide 26 and the front side regulating surface 242 provided on the front side regulation guide 24.

Figure 5A:
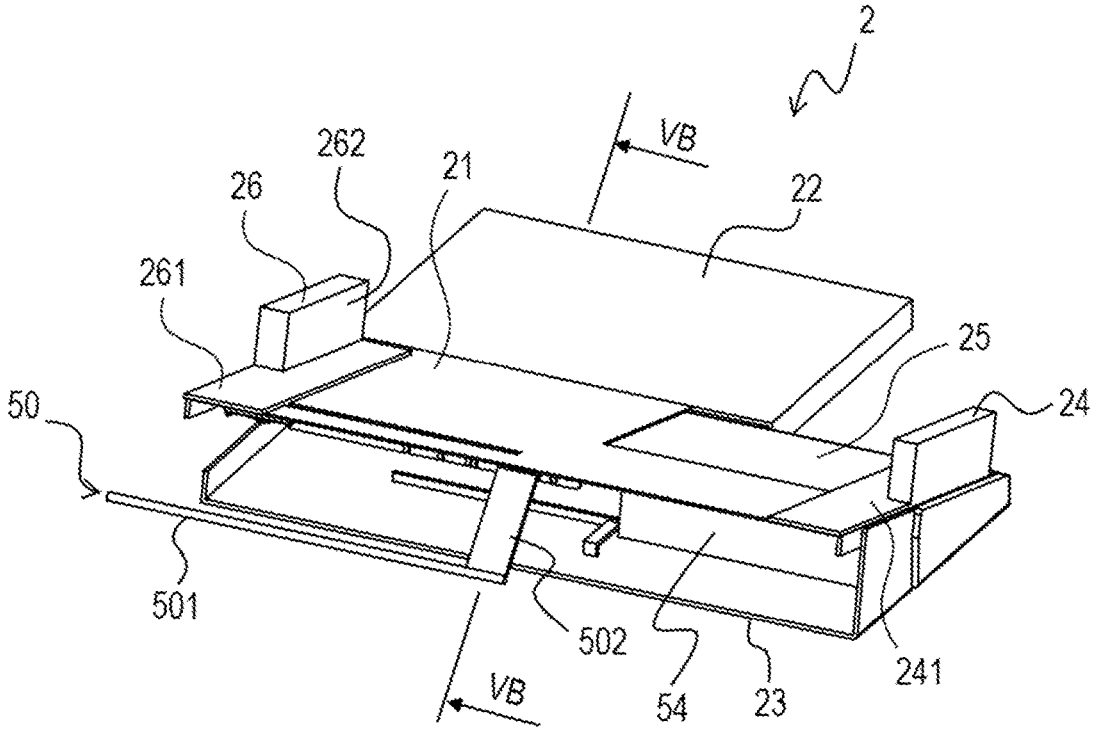
FIG. 5A and FIG. 5B are views of a document tray in a first embodiment when a small number of documents are fed.
Figure 5B:
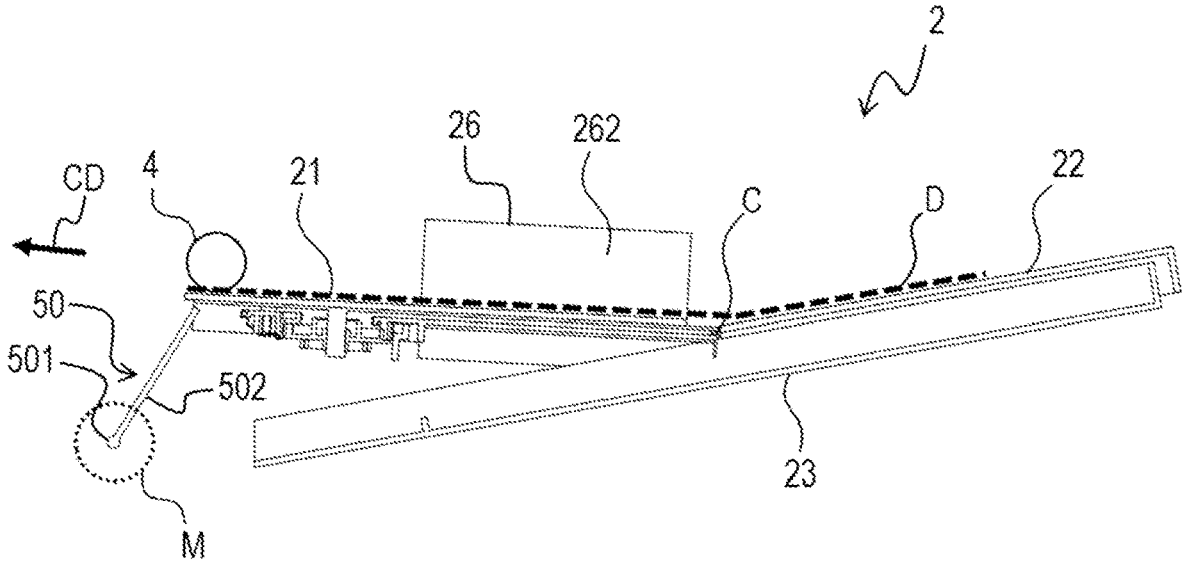

FIG. 5A and FIG. 5B are views of the document tray 2 in the first embodiment when a small number of documents are fed. FIG. 5A is a perspective view of the document tray 2 when the small number of documents are fed. FIG. 5B is a cross-sectional view of the document tray 2 taken along the line VB-VB in FIG. 5A. The documents D are stacked on the rear side stacking surface 261, the front side stacking surface 241, the telescopic tray 25, the first upper document tray 21, and the second upper document tray 22. The first upper document tray 21 is supported rotatably with respect to a lower document tray (lower tray member) 23. The second upper document tray 22 is fixed to the lower document tray 23. The automatic document feeder 1 is provided with a lifter 50 as a raising and lowering device configured to raise and lower the first upper document tray 21. The lifter 50 includes a motor M as a driving portion, a rotation shaft 501 which is rotated by the motor M, and a lifter plate 502 connected to the rotation shaft 501 and configured to be rotated integrally with the rotation shaft 501. When the rotation shaft 501 is rotated by a driving force from the motor M, the lifter plate 502 is rotated around the rotation shaft 501 and brought into contact with the first upper document tray 21 to raise the first upper document tray 21. The first upper document tray 21 is brought close to the feeding roller 4. The first upper document tray 21 is rotated around a point C with respect to the lower document tray 23 by the lifter plate 502, a downstream end portion of the first upper document tray 21 in the feeding direction CD is raised, and the document D is fed in contact with the feeding roller 4. By a reverse rotation of the motor M, the first upper document tray 21 is moved away from the feeding roller 4.

Figure 6:
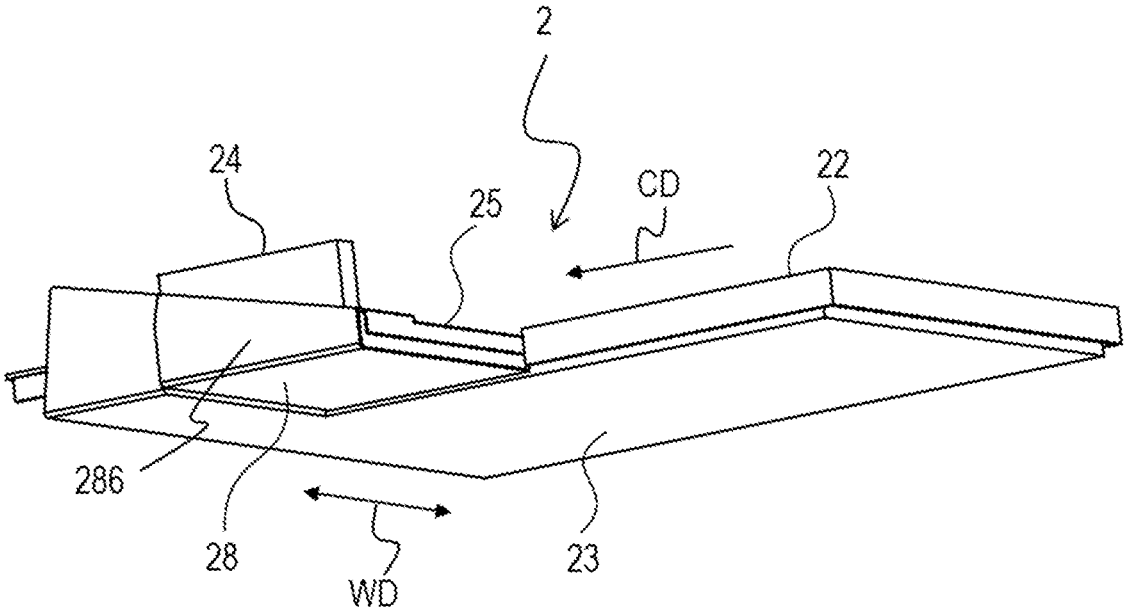
FIG. 6 is a perspective view of the document tray as seen from a discharge tray.

FIG. 6 is a perspective view of the document tray 2 as seen from the discharge tray 3. The first upper document tray 21 (not shown in FIG. 6), the second upper document tray 22, the front side regulation guide 24, and the rear side regulation guide 26 (not shown in FIG. 6) are covered from the lower side by the lower document tray 23. The telescopic tray 25 is covered from the lower side by a telescopic tray cover (tray cover) 28. The telescopic tray cover 28 is configured to be movable in the width direction WD integrally with the telescopic tray 25.

Figure 7A:
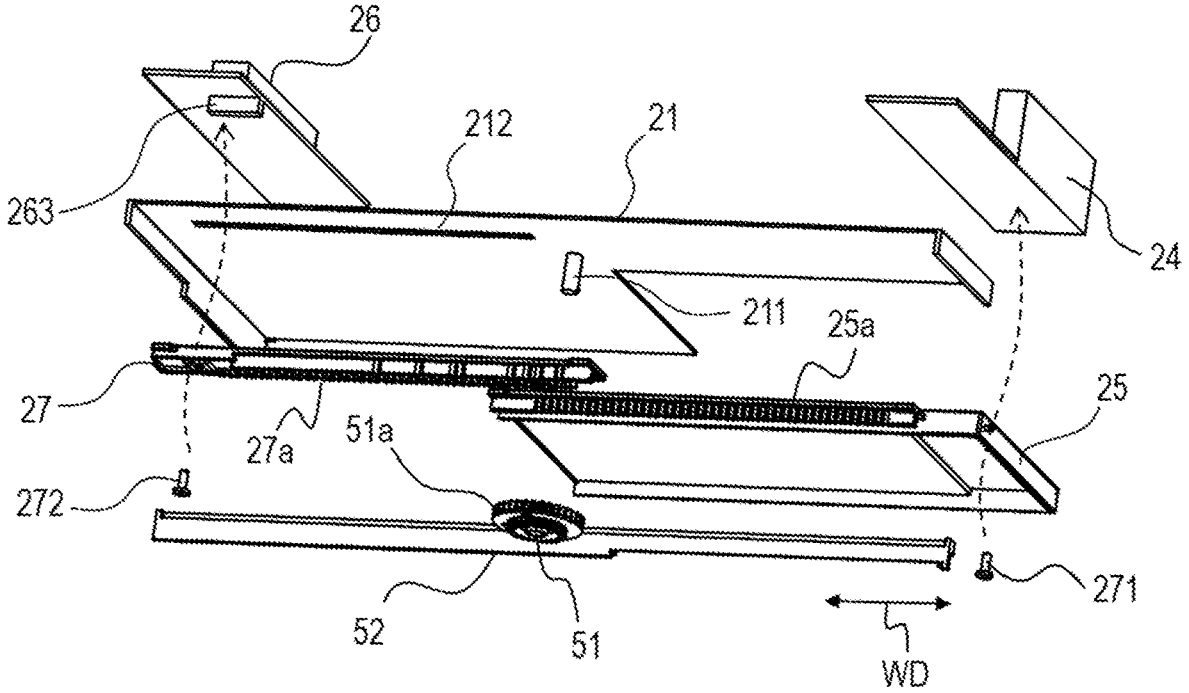
FIG. 7A, FIG. 7B, and FIG. 7C are views of a first upper document tray, a telescopic tray, a front side regulation guide, and a rear side regulation guide.
Figure 7B:
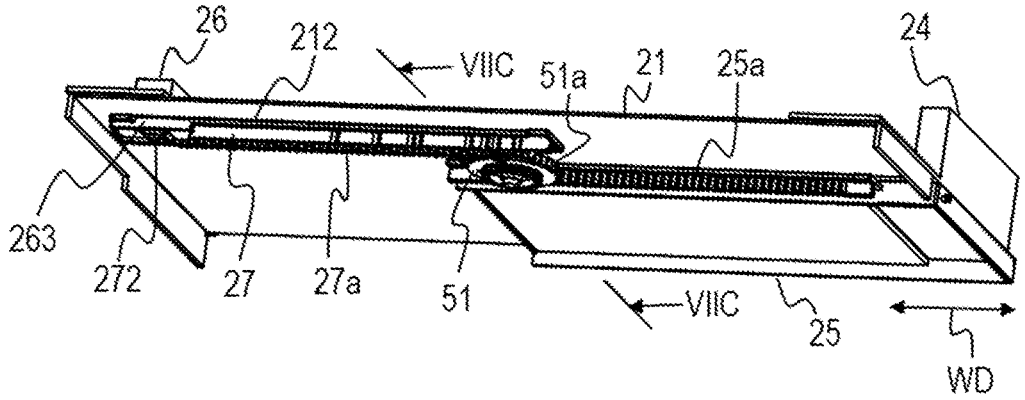
Figure 7C:
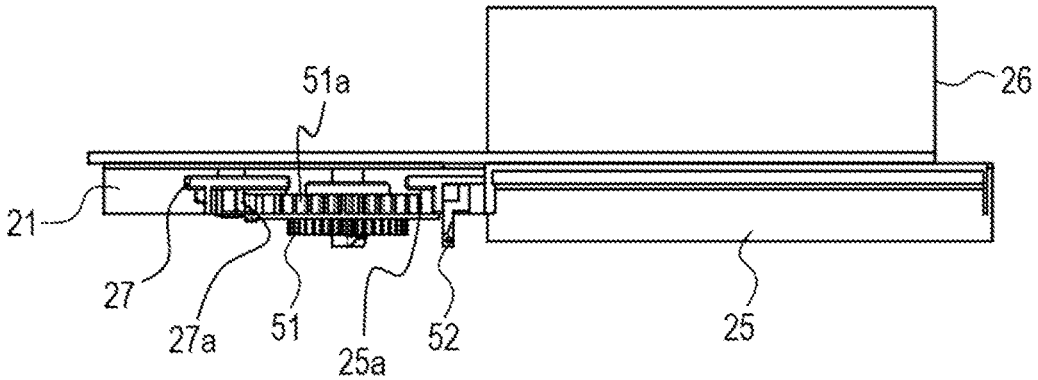

FIG. 7A, FIG. 7B, and FIG. 7C are views of the first upper document tray 21, the telescopic tray 25, the front side regulation guide 24, and the rear side regulation guide 26. FIG. 7A is a view of the first upper document tray 21, the telescopic tray 25, the front side regulation guide 24, and the rear side regulation guide 26 before assembly. FIG. 7B is a view of the first upper document tray 21, the telescopic tray 25, the front side regulation guide 24, and the rear side regulation guide 26 after assembly. FIG. 7C is a cross-sectional view taken along the line VIIC-VIIC in FIG. 7B. The front side regulation guide 24 and the telescopic tray 25 are disposed so as to sandwich the first upper document tray 21, and are connected by a fixing member 271 to be integrally movable in the width direction WD. The front side regulation guide 24 is movable above an upper surface of the first upper document tray 21, and the telescopic tray 25 is movable below a lower surface of the first upper document tray 21.

A guide member 52 is connected to the first upper document tray 21 so that the telescopic tray 25 is sandwiched between the guide member 52 and the first upper document tray 21. The rear side regulation guide 26 and a guide rack 27 are disposed so as to sandwich the first upper document tray 21, and are connected by a fixing member 272 so that the rear side regulation guide 26 and the guide rack 27 are configured to be movable in the width direction WD as a unit. A protrusion 263 provided on the rear side regulation guide 26 is disposed in a slit 212 provided in the first upper document tray 21. The protrusion 263 is movable in the width direction WD along the slit 212 and functions as a guide for the movement of the rear side regulation guide 26 in the width direction WD.

A connecting member 51 is rotatably connected to a shaft 211 provided on the first upper document tray 21. The connecting member 51 is disposed to be sandwiched between the telescopic tray 25 and the guide rack 27. Gear teeth 51*a* provided on the connecting member 51 mesh with gear teeth 25*a* provided on the telescopic tray 25 and gear teeth 27*a* provided on the guide rack 27. With this, the rear side regulation guide 26 and the front side regulation guide 24 are configured to be movable in association with each other in the width direction WD with respect to the document tray 2.

Figure 8A:
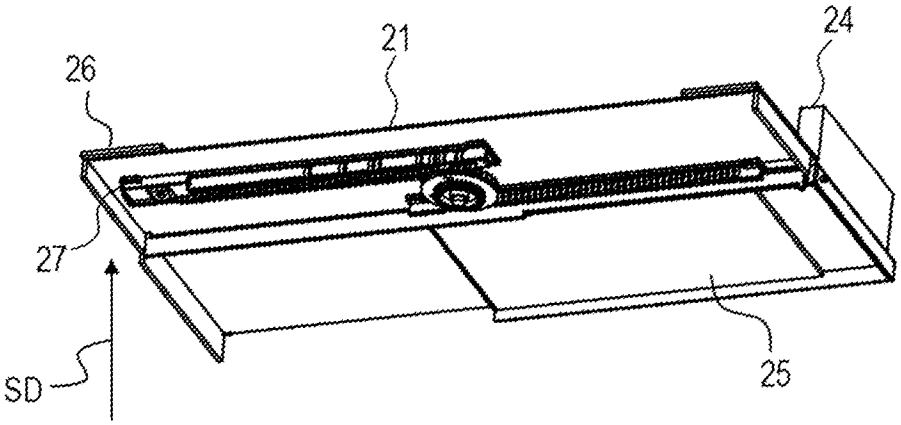
FIG. 8A, FIG. 8B, FIG. 8C, and FIG. 8D are explanatory views of a movement of the rear side regulation guide and the front side regulation guide.
Figure 8B:
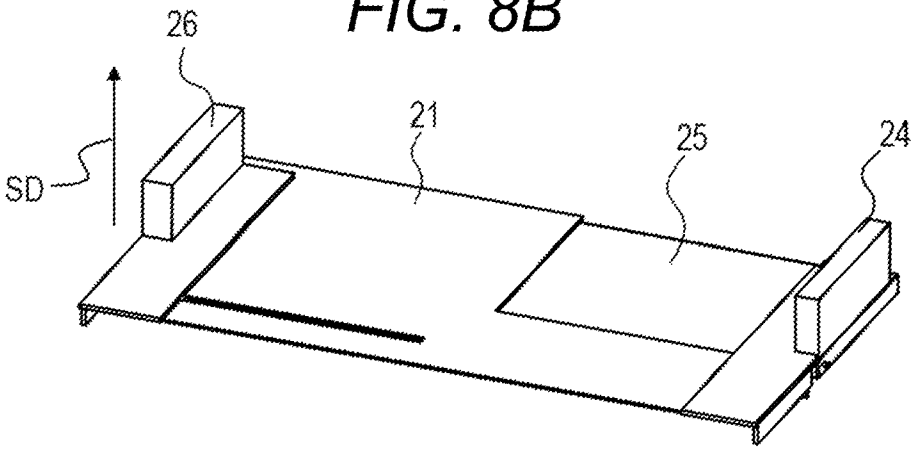
Figure 8C:
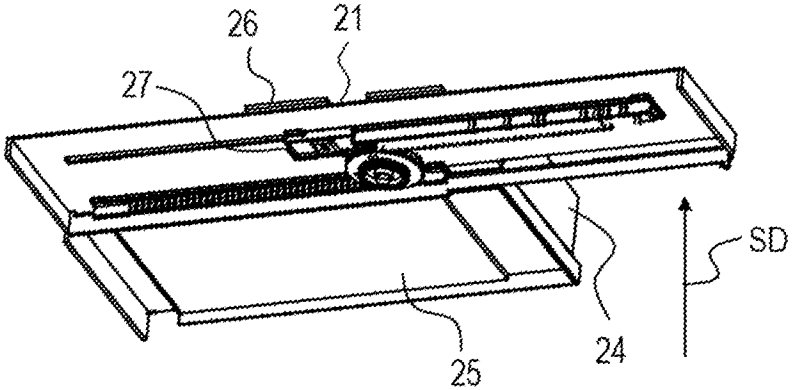
Figure 8D:
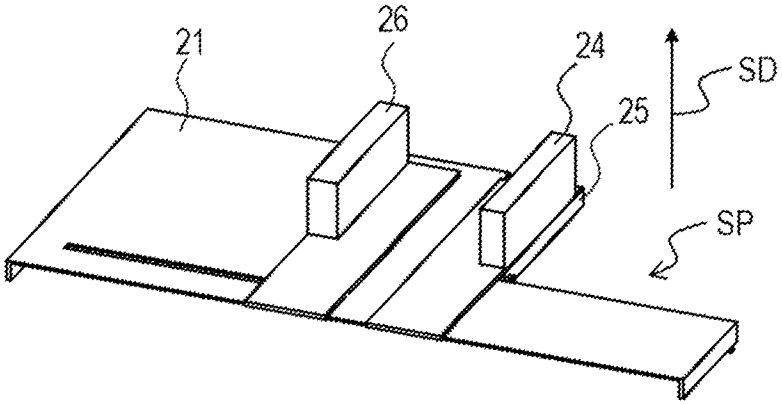

FIG. 8A, FIG. 8B, FIG. 8C, and FIG. 8D are explanatory views of the movement of the rear side regulation guide 26 and the front side regulation guide 24. FIG. 8A and FIG. 8C are perspective views as seen from below in the stacking direction SD of the documents. FIG. 8B and FIG. 8D are perspective views as seen from above in the stacking direction SD of the documents. When large-size documents are stacked on the document tray 2, the rear side regulation guide 26 and the front side regulation guide 24 are moved in association with each other so as to be separated from each other as shown in FIG. 8A and FIG. 8B. When small-size documents are stacked on the document tray 2, the rear side regulation guide 26 and the front side regulation guide 24 are moved in association with each other so as to be moved closer to each other as shown in FIG. 8C and FIG. 8D. When the small-size documents are stacked on the document tray 2, the telescopic tray 25 is retracted under the first upper document tray 21 to form a space SP through which the user can easily see the discharge tray 3.

Figure 9A:
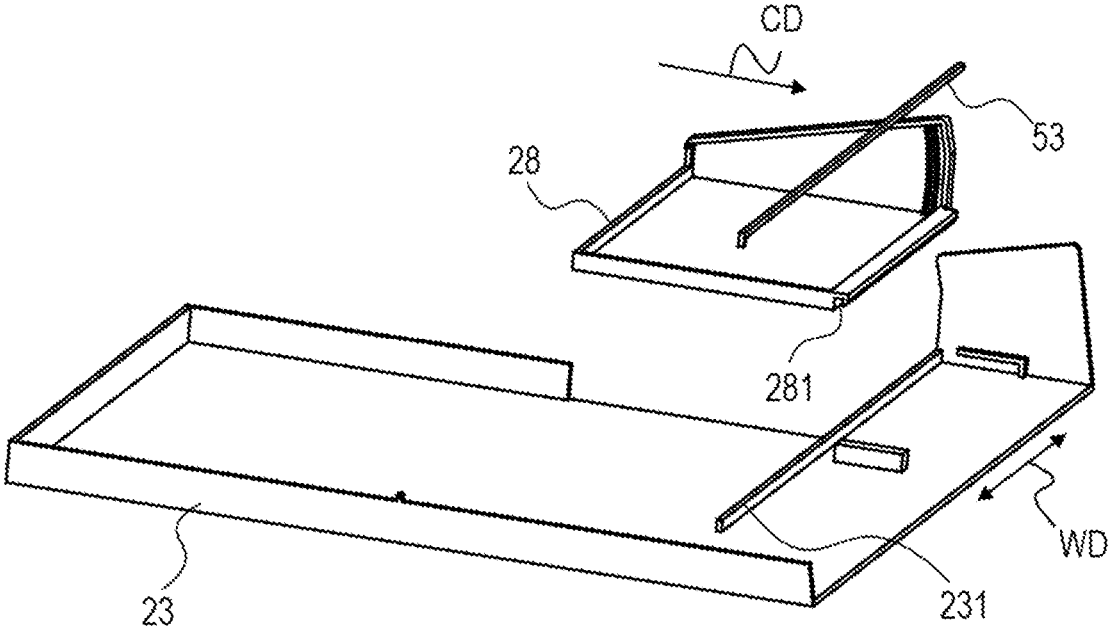
FIG. 9A and FIG. 9B are perspective views of a lower document tray and a telescopic tray cover.
Figure 9B:
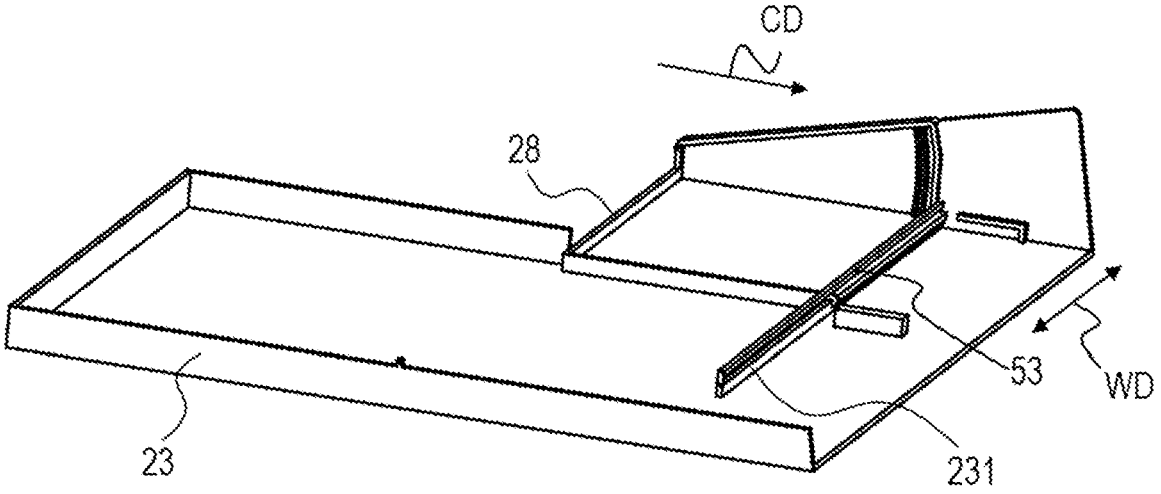

FIG. 9A and FIG. 9B are perspective views of the lower document tray 23 and the telescopic tray cover 28. FIG. 9A is a perspective view of the lower document tray 23 and the telescopic tray cover 28 before assembly. FIG. 9B is a perspective view of the lower document tray 23 and the telescopic tray cover 28 after assembly. A guide member 53 is connected to the lower document tray 23 so as to sandwich the telescopic tray cover 28 between the guide member 53 and the lower document tray 23. A hooking portion 281 provided on the telescopic tray cover 28 is disposed so as to be caught by a rail portion 231 provided on the lower document tray 23. Thus, the telescopic tray cover 28 is configured to be movable in the width direction WD with respect to the lower document tray 23.

Figure 10A:
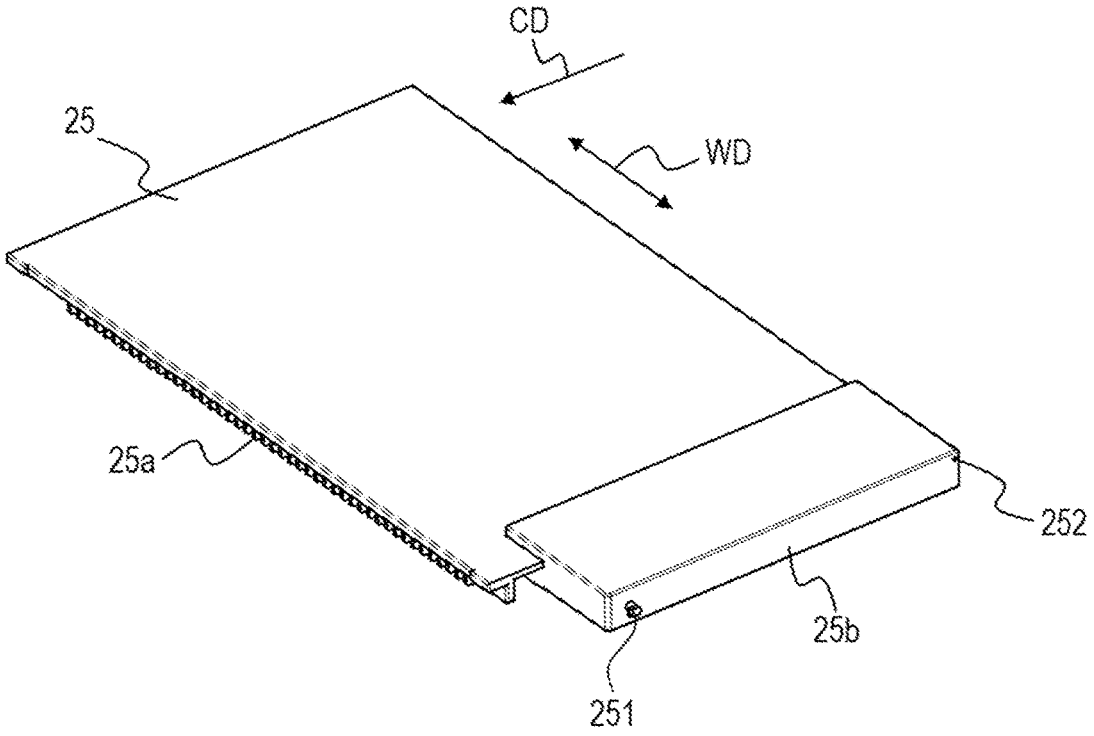
FIG. 10A, FIG. 10B, and FIG. 10C are views of a telescopic tray in the first embodiment.
Figure 10B:
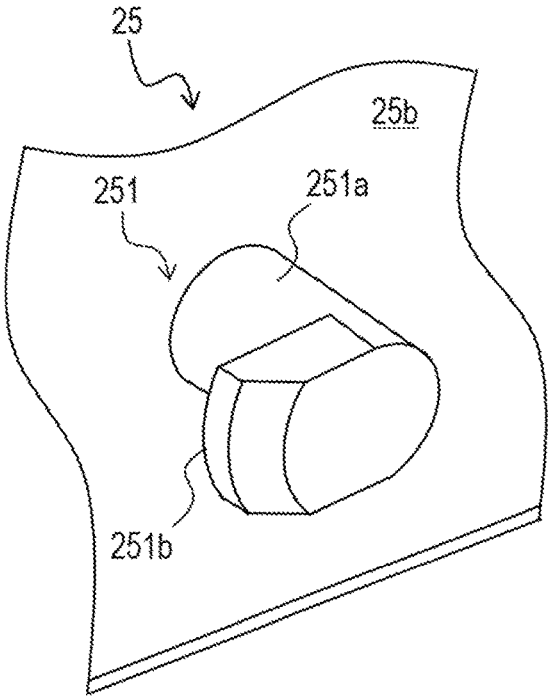
Figure 10C:
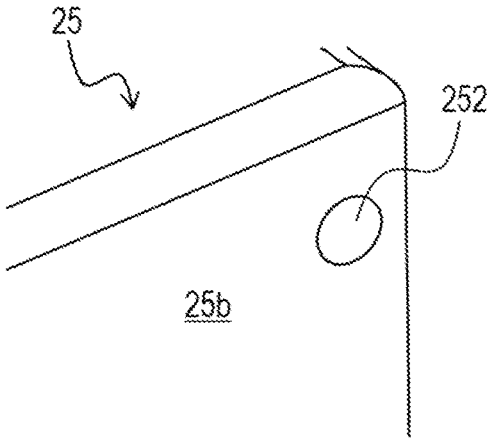

FIG. 10A, FIG. 10B, and FIG. 10C are views of the telescopic tray 25 in the first embodiment. FIG. 10A is a perspective view of the telescopic tray 25. FIG. 10B is an enlarged view of a mounting claw 251. FIG. 10C is an enlarged view of a mounting hole 252. In the telescopic tray 25, the gear teeth 25*a* are provided at a side end portion of the telescopic tray 25 on the downstream side in the feeding direction CD of the document. In the telescopic tray 25, the mounting claw 251 and the mounting hole 252 are provided on an end portion 25*b* of the telescopic tray 25 on the front side of the image forming apparatus 101 in the width direction WD. The mounting claw 251 is provided with a shaft portion 251*a* and a hooking portion 251*b* provided on a tip portion of the shaft portion 251*a*.

Figure 11A:
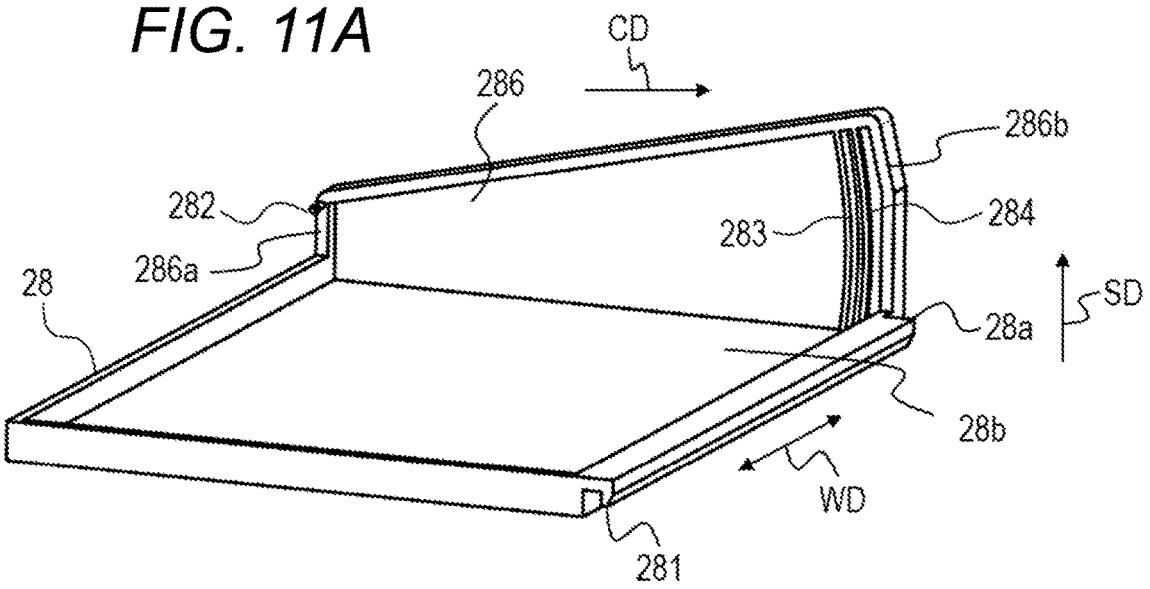
FIG. 11A, FIG. 11B, FIG. 11C, and FIG. 11D are views of the telescopic tray cover in the first embodiment.
Figure 11B:
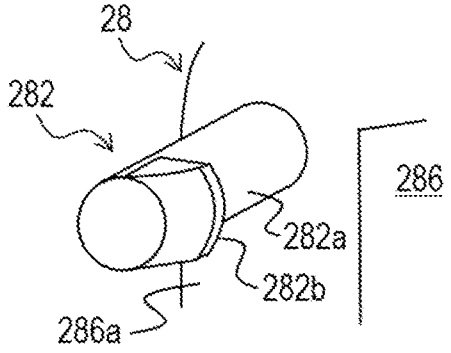
Figure 11C:
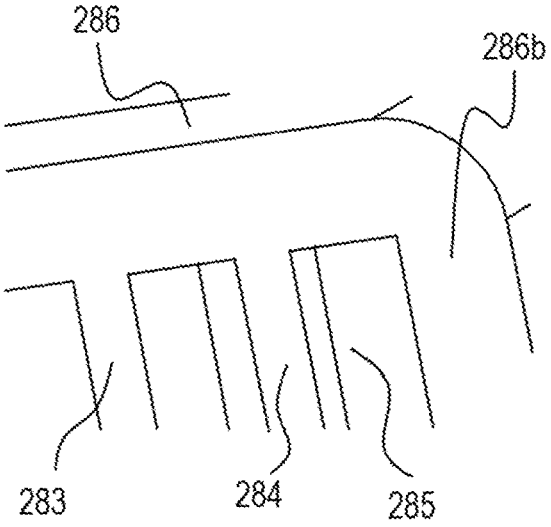
Figure 11D:
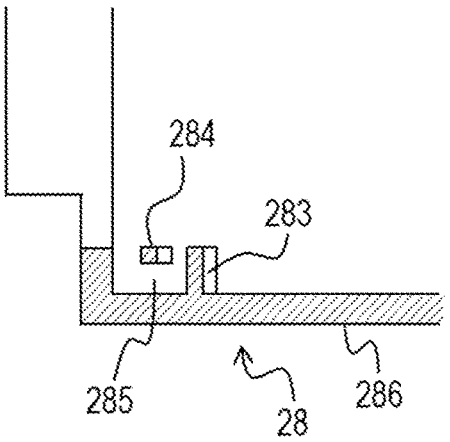

FIG. 11A, FIG. 11B, FIG. 11C, and FIG. 11D are views of the telescopic tray cover 28 in the first embodiment. FIG. 11A is a perspective view of the telescopic tray cover 28. FIG. 11B is a partial view of the vicinity of a mounting claw 282. FIG. 11C is a partial enlarged view of a first guide rib 283 and a second guide rib 284. FIG. 11D is a partial cross-sectional view of the telescopic tray cover 28 as seen from above in the stacking direction SD of the documents. The telescopic tray cover 28 has a wall portion 286 extending from a bottom portion 28*b* of the telescopic tray cover 28 in the stacking direction SD at an end portion 28*a* of the telescopic tray cover 28 on the front side of the image forming apparatus 101 in the width direction WD. The wall portion 286 has the mounting claw 282 at an end portion 286*a* on the upstream side in the feeding direction CD of the document. The wall portion 286 has the first guide rib 283 and the second guide rib 284 at an end portion 286*b* on the downstream side in the feeding direction CD of the document. The mounting claw 282 has a shaft portion 282*a* and a hooking portion 282*b* provided at a tip portion of the shaft portion 282*a*. The first guide rib 283 and the second guide rib 284 are disposed on their respective arcs around the mounting claw 282. A slit (groove portion) 285 is provided between the second guide rib 284 and the wall portion 286.

Figure 12A:
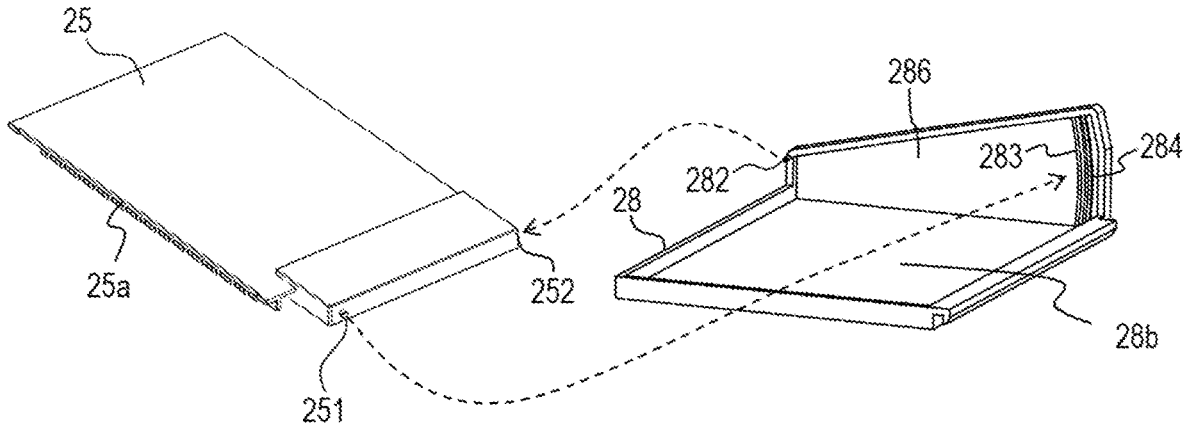
FIG. 12A, FIG. 12B, FIG. 12C, and FIG. 12D are views of the telescopic tray and the telescopic tray cover in the first embodiment.
Figure 12B:
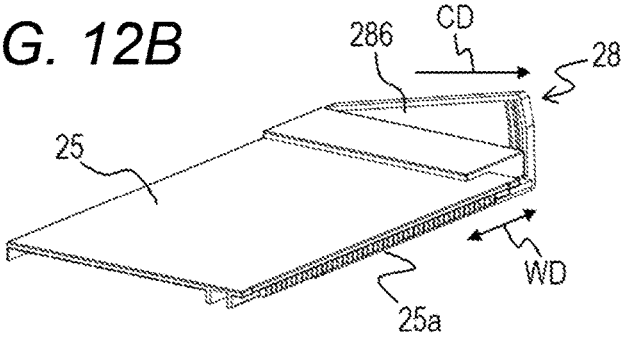
Figure 12C:
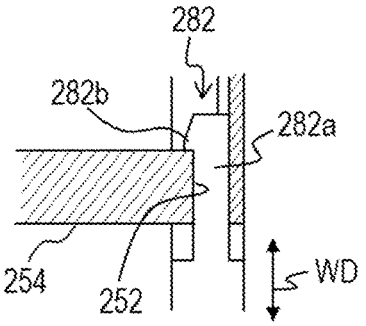
Figure 12D:
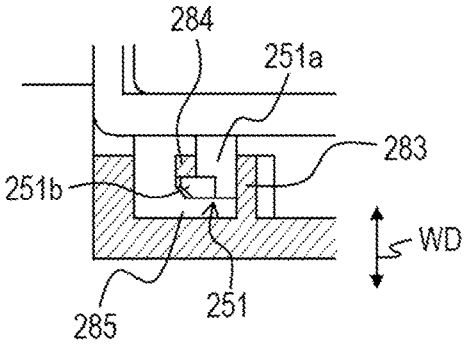

FIG. 12A, FIG. 12B, FIG. 12C, and FIG. 12D are views of the telescopic tray 25 and the telescopic tray cover 28 in the first embodiment. FIG. 12A is a perspective view of the telescopic tray 25 and the telescopic tray cover 28 before assembly. FIG. 12B is a perspective view of the telescopic tray 25 and the telescopic tray cover 28 after assembly. FIG. 12C is an enlarged cross-sectional view of the mounting claw 282 locked to the mounting hole 252. FIG. 12D is an enlarged cross-sectional view of the mounting claw 251 locked to the second guide rib 284. The mounting claw (protrusion) 251 of the telescopic tray 25 is inserted between the first guide rib 283 and the second guide rib 284 of the telescopic tray cover 28, and the hooking portion 251*b* of the mounting claw 251 is caught by the second guide rib 284 in the slit 285. The mounting claw 282 of the telescopic tray cover 28 is inserted into the mounting hole 252 of the telescopic tray 25, and the hooking portion 282*b* of the mounting claw 282 is caught by an inside surface 254 of the telescopic tray 25. Thus, the telescopic tray 25 is connected to the telescopic tray cover 28. Since the hooking portion 251*b* of the mounting claw 251 is caught by the second guide rib 284 in the slit 285 and the hooking portion 282*b* of the mounting claw 282 is caught by the inside surface 254 of the telescopic tray 25, the movement of the telescopic tray 25 with respect to the telescopic tray cover 28 in the width direction WD is regulated. The shaft portion 282*a* of the mounting claw 282 is held rotatably with respect to the mounting hole 252. The hooking portion 251*b* of the mounting claw 251 is movable in the slit (groove portion) 285 between the second guide rib 284 and the wall portion 286. With this, the telescopic tray 25 is configured to be rotatable with respect to the telescopic tray cover 28 around the mounting hole (first rotation supporting point) 252.

Figure 13A:
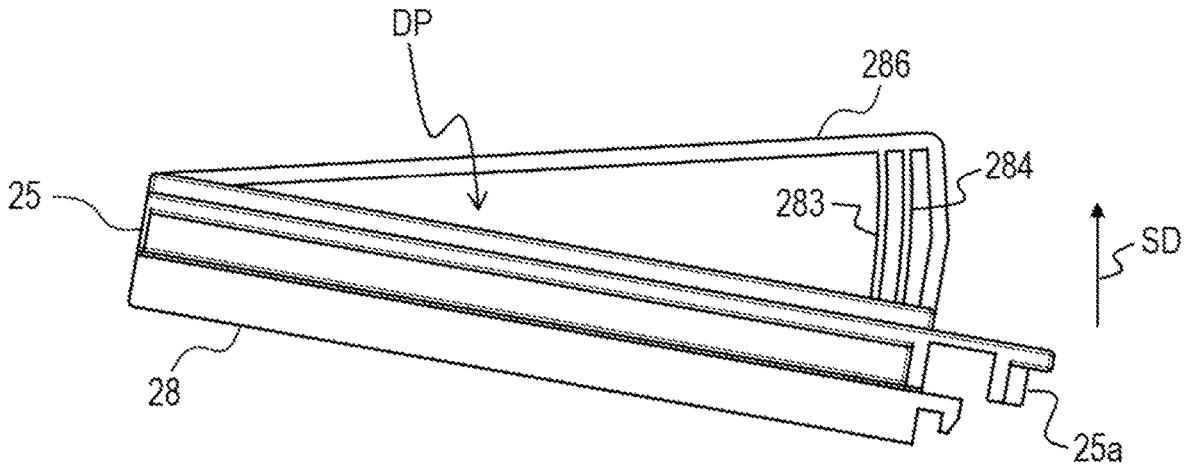
FIG. 13A and FIG. 13B are explanatory views of the rotation of the telescopic tray with respect to the telescopic tray cover in the first embodiment.
Figure 13B:
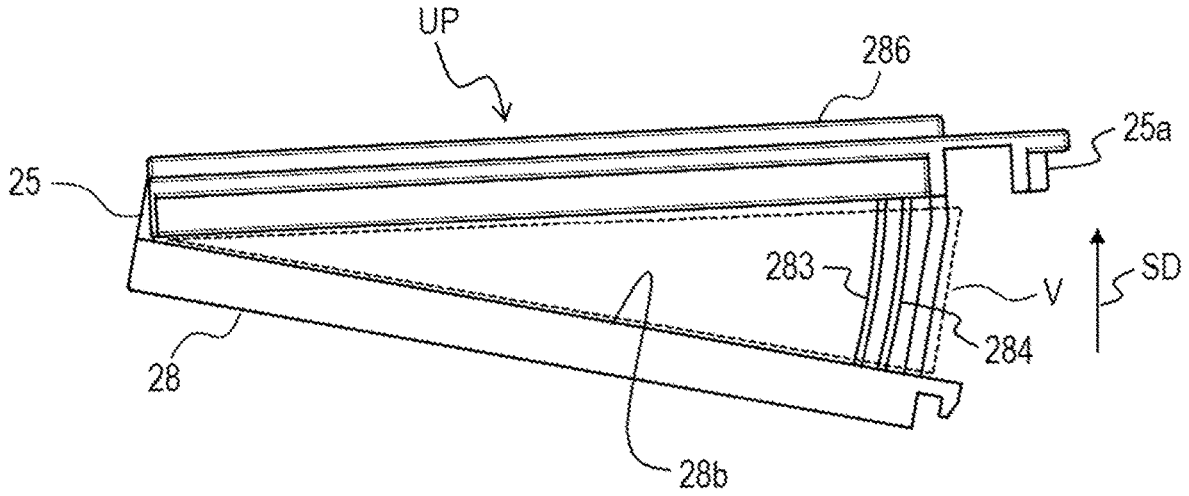

FIG. 13A and FIG. 13B are explanatory views of the rotation of the telescopic tray 25 with respect to the telescopic tray cover 28 in the first embodiment. In FIG. 13A, the telescopic tray 25 is rotated downward with respect to the telescopic tray cover 28 to be in a lowered position DP. In FIG. 13B, the telescopic tray 25 is rotated upward in the stacking direction SD with respect to the telescopic tray cover 28 to be in a raised position UP. When the telescopic tray 25 is rotated upward in the stacking direction SD with respect to the telescopic tray cover 28, an air gap V (gap) is created between the telescopic tray 25 and the telescopic tray cover 28. The wall portion 286 is extended upward from the bottom portion 28*b* of the telescopic tray cover 28 in the stacking direction SD so as to cover the air gap V from the front side of the image forming apparatus 101.

Figure 14A:
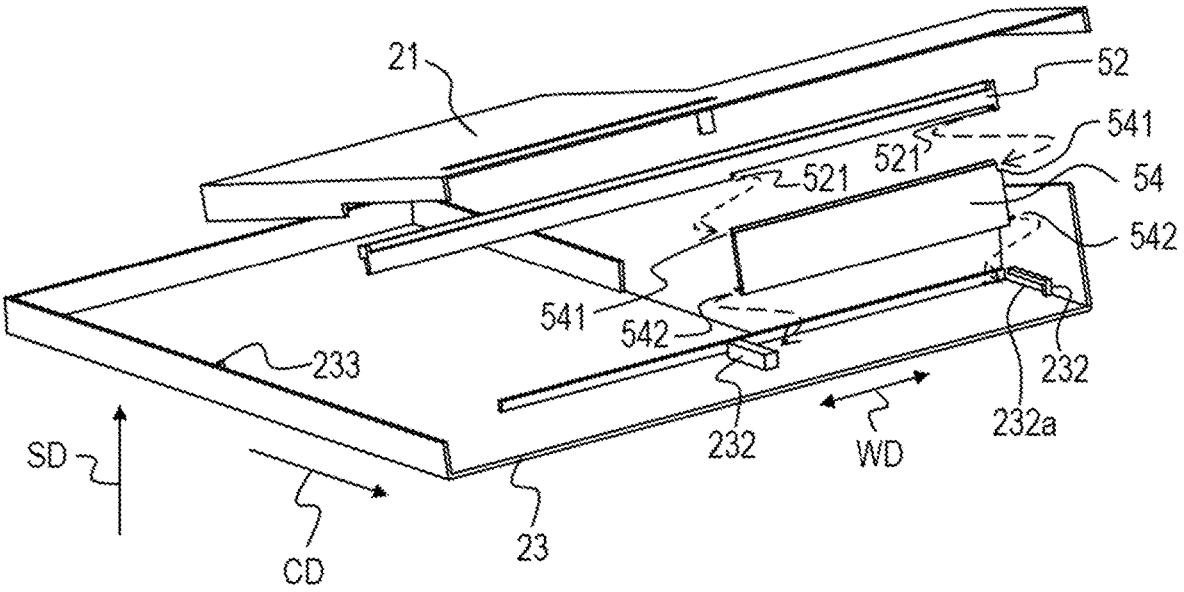
FIG. 14A and FIG. 14B are views of the first upper document tray and the lower document tray in the first embodiment.
Figure 14B:
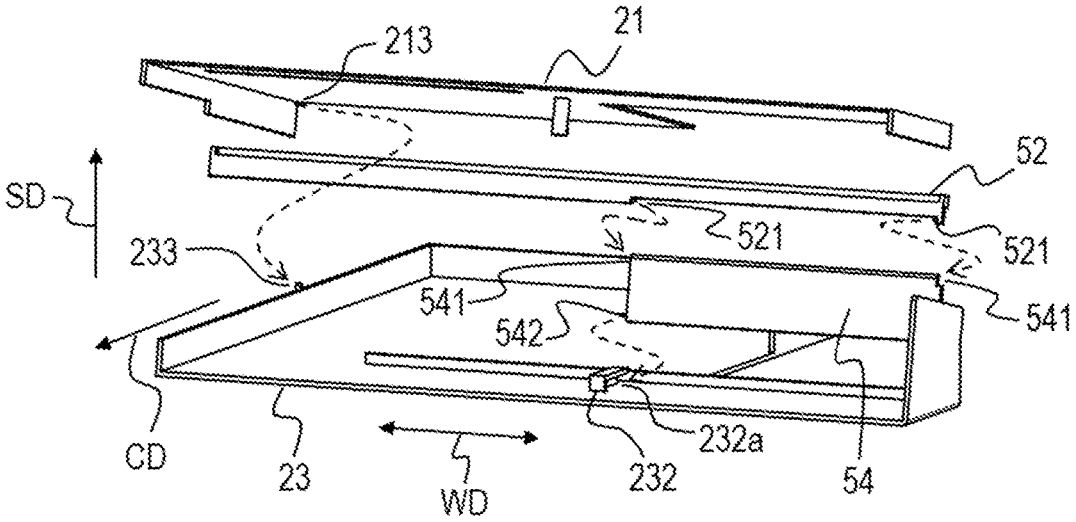

FIG. 14A and FIG. 14B are views of the first upper document tray 21 and the lower document tray 23 in the first embodiment. FIG. 14A is a perspective view of the first upper document tray 21 and the lower document tray 23 before assembly as seen from the left oblique rear side. FIG. 14B is a perspective view of the first upper document tray 21 and the lower document tray 23 before assembly as seen from the left oblique front side. A mounting shaft 213 provided on the first upper document tray 21 is inserted into a mounting hole (second rotation supporting point) 233 provided in the lower document tray 23. The mounting shaft 213 corresponds to the point C shown in FIG. 5B. Thus, the first upper document tray 21 is configured to be rotatable around the point C (FIG. 5B) with respect to the lower document tray 23. At this time, the mounting hole 233 is positioned at the same position as the mounting hole 252 (FIG. 10A) of the telescopic tray 25 in the feeding direction CD and in the stacking direction SD. That is, the mounting hole 233 of the lower document tray 23 as the second rotation supporting point is coaxially disposed in line with the mounting hole 252 of the telescopic tray 25 as the first rotation supporting point.

The guide member 52 is fixed to the lower surface of the first upper document tray 21. In FIG. 14A and FIG. 14B, for purposes of illustration, the guide member 52 is separated from the first upper document tray 21. The guide member 52 is provided with two mounting shafts 521. A shutter (cover member) 54 is provided with mounting holes 541 in upper portions of both end portions in the longitudinal direction, respectively. Two mounting shafts 521 of the guide member 52 are inserted into the two mounting holes 541 of the shutter 54, respectively. With this, the shutter 54 is held rotatably with respect to the guide member 52. The shutter 54 is connected rotatably with respect to the first upper document tray 21 via the guide member 52. The shutter 54 is provided with mounting shafts (protrusions) 542 in lower portions of both end portions in the longitudinal direction, respectively. The lower document tray 23 is provided with two guide portions 232. The two guide portions 232 are provided with groove holes 232*a* extending in the feeding direction CD, respectively. The two mounting shafts 542 of the shutter 54 are inserted into the groove holes 232*a* in the two guide portions (rail portions) 232 of the lower document tray 23, respectively. With this, the two mounting shafts 542 on the lower end portion of the shutter 54 are held movably in the feeding direction CD by the groove holes 232*a* of the guide portions 232.

Figure 15A:
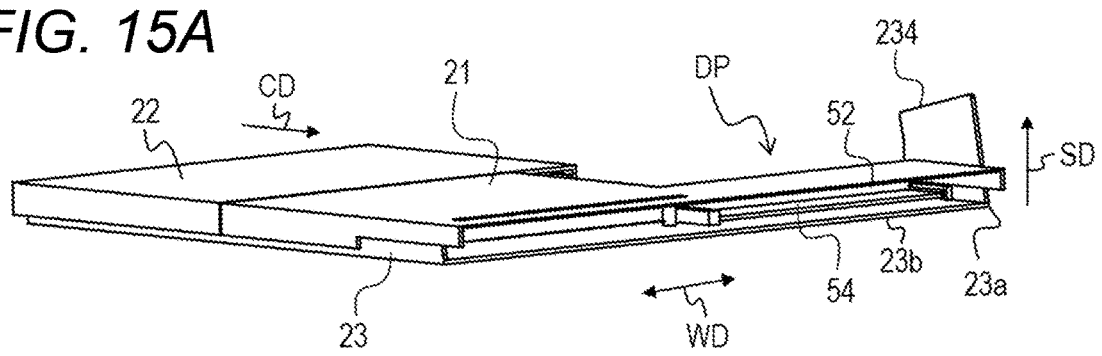
FIG. 15A, FIG. 15B, FIG. 15C, FIG. 15D, and FIG. 15E are explanatory views of the rotation of the first upper document tray with respect to the lower document tray in the first embodiment.
Figure 15B:
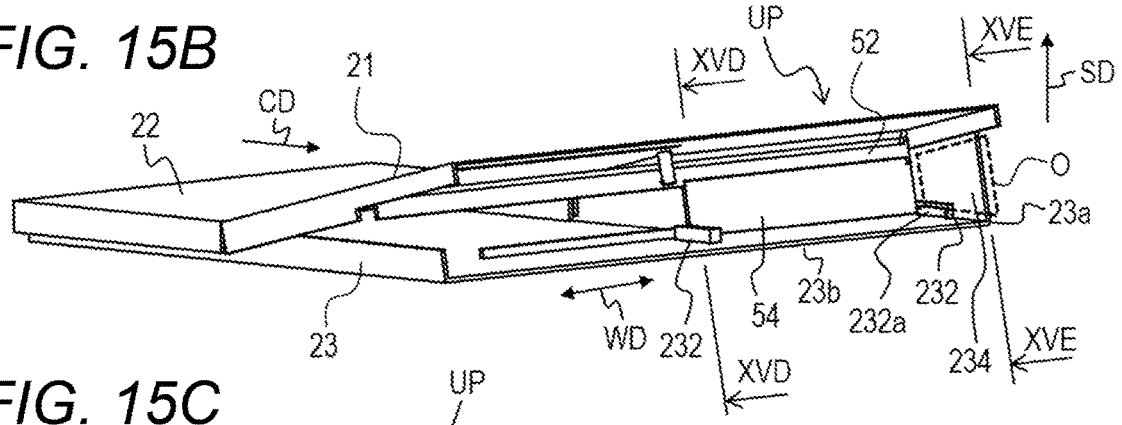
Figure 15C:
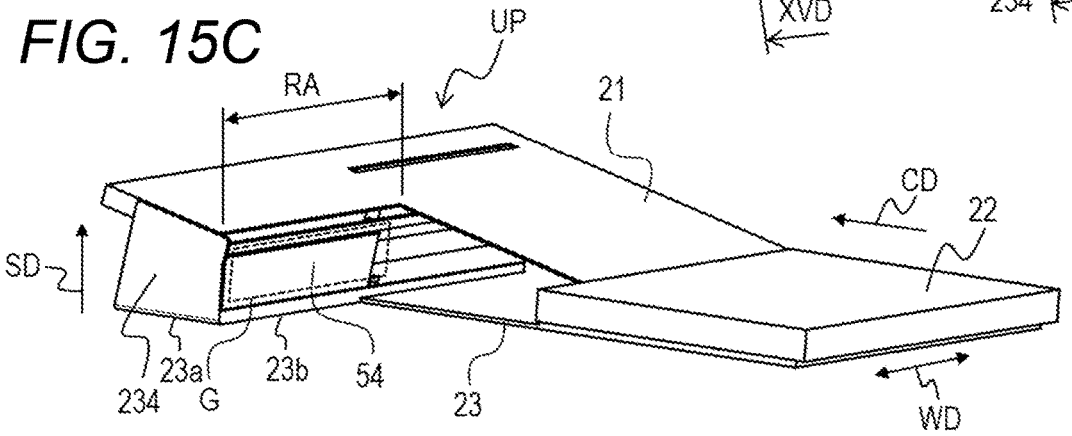

FIG. 15A, FIG. 15B, FIG. 15C, FIG. 15D, and FIG. 15E are explanatory views of the rotation of the first upper document tray 21 with respect to the lower document tray 23 in the first embodiment. FIG. 15A is a perspective view as seen from the left oblique rear side when the first upper document tray 21 is in the lowered position DP without upward rotation. FIG. 15B is a perspective view as seen from the left oblique rear side when the first upper document tray 21 is in the raised position UP with upward rotation. FIG. 15C is a perspective view as seen from the right oblique front side when the first upper document tray 21 is in the raised position UP with upward rotation. As shown in FIG. 15A, when the first upper document tray 21 is in the lowered position DP without upward rotation in the stacking direction SD, the shutter 54 is stored between the first upper document tray 21 and the lower document tray 23. As shown in FIG. 15B, when the first upper document tray 21 is rotated from the lowered position DP to the raised position UP, the shutter 54 is rotated and raised in such a manner that the lower end portion of the shutter 54 is moved along the groove holes 232*a* of the guide portions 232 to the upstream side in the feeding direction CD. When the first upper document tray 21 is in the raised position UP, the shutter 54 is raised and is exposed between the first upper document tray 21 and the lower document tray 23. At this time, the shutter 54 covers an air gap G (gap) created between the first upper document tray 21 and the lower document tray 23 on the upstream side in the feeding direction CD within a range RA in which the wall portion 286 of the telescopic tray cover 28 is moved in the width direction WD between a pullout position (first position) PP and a retracted position (second position) RP. The pullout position PP and the retracted position RP will be described later with reference to FIG. 16A and FIG. 16B. That is, when the first upper document tray 21, the telescopic tray 25, the front side regulation guide 24, and the rear side regulation guide 26 are in the raised position UP and the front side regulation guide 24 and the telescopic tray 25 are in the retracted position RP, the air gap G (gap) is created. The shutter 54 covers the air gap G (gap) created between the first upper document tray 21 and the lower document tray 23 on the downstream side of the telescopic tray 25 in the feeding direction CD. The lower document tray 23 is provided with a wall portion 234 extending upward in the stacking direction SD from a bottom portion 23*b* of the lower document tray 23 on an end portion 23*a* on the front side of the image forming apparatus 101 in the width direction WD. The wall portion 234 covers an air gap 0 (gap) created between the first upper document tray 21 and the lower document tray 23 on the front side in the width direction WD.

Figure 15D:
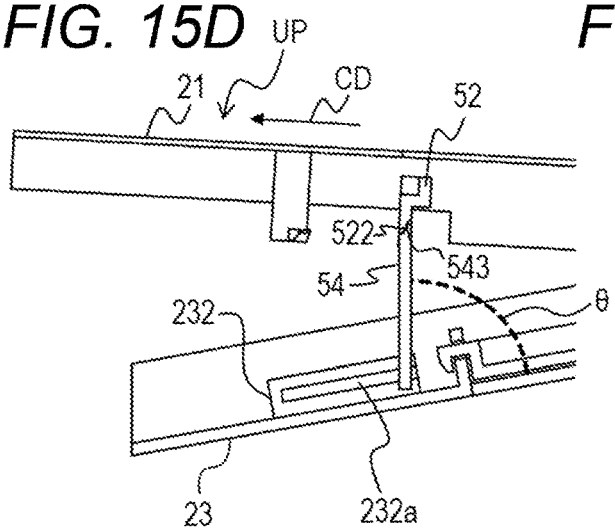
Figure 15E:
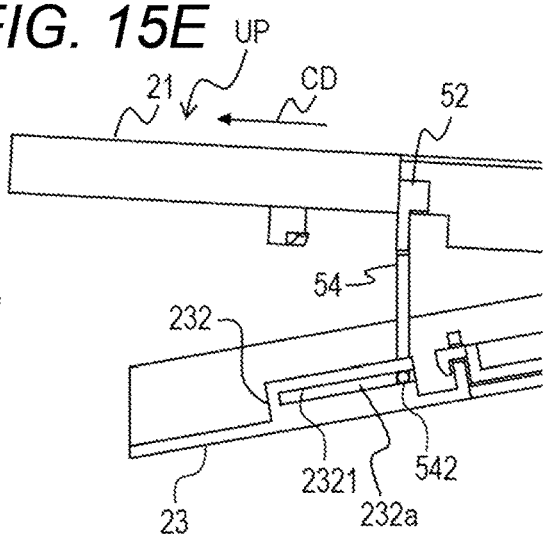

FIG. 15D is a cross-sectional view taken along line XVD-XVD in FIG. 15B. FIG. 15E is a cross-sectional view taken along line XVE-XVE in FIG. 15B. As shown in FIG. 15D, when the first upper document tray 21 is in the raised position UP, an inclined portion 543 (first abutment portion) provided on the shutter 54 contacts (abuts) an inclined portion 522 (second abutment portion) provided on the guide member 52. At this time, an angle θ formed by the shutter 54 and the lower document tray 23 on the upstream side in the feeding direction CD of the document is an acute angle. Therefore, when the first upper document tray 21 is rotated downward in the direction away from the feeding roller 4, the mounting shafts 542 of the shutter 54 can move in the groove holes 232*a* of the guide portions 232 without resistance. Moreover, when the first upper document tray 21 is in the raised position UP as shown in FIG. 15E, the mounting shafts 542 are in contact with inclined surfaces (regulating surfaces) 2321 of the groove holes 232*a*. Therefore, even if the shutter 54 receives a force (external force) from the upstream side in the feeding direction CD, the shutter 54 does not rotate.

Figure 16A:
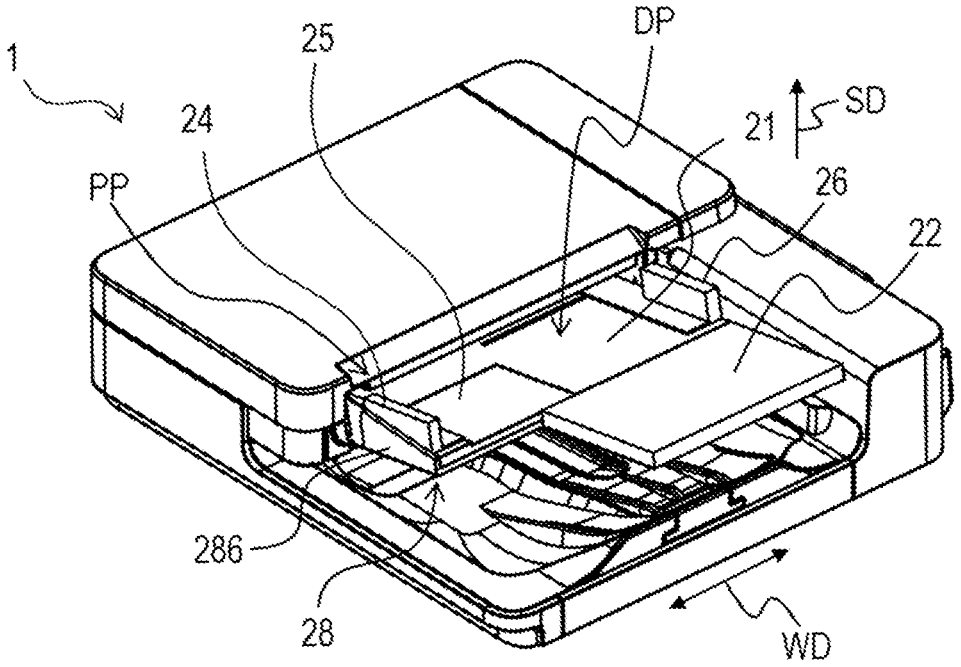
FIG. 16A and FIG. 16B are perspective views of the automatic document feeder in the first embodiment when large-size documents are fed.
Figure 16B:
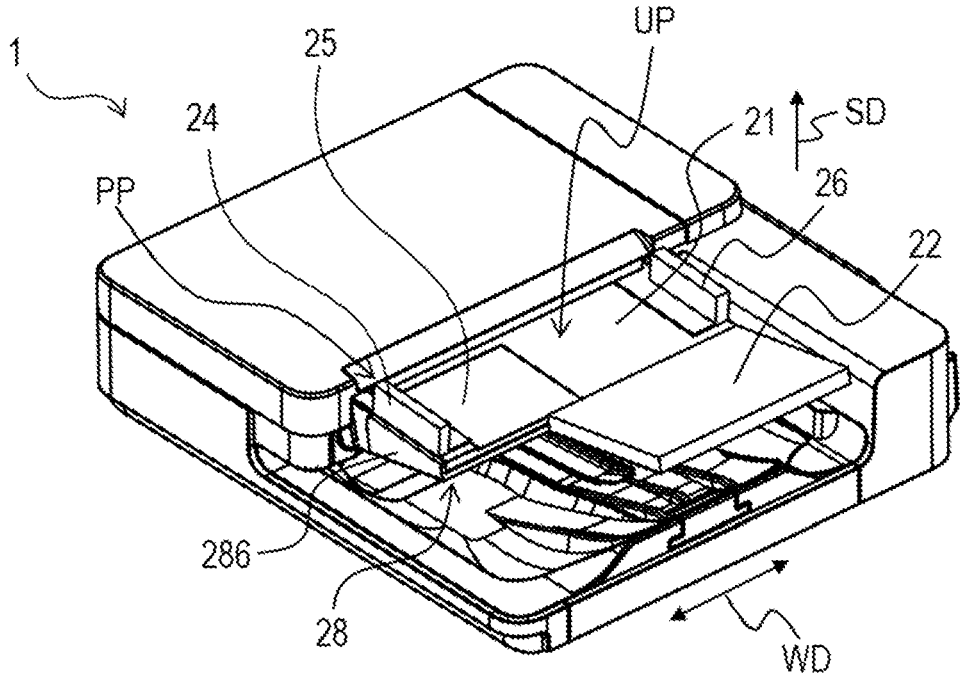

FIG. 16A and FIG. 16B are perspective views of the automatic document feeder 1 in the first embodiment when large-size documents are fed. FIG. 16A is a perspective view of the automatic document feeder 1 when a large number of large-size documents are fed. FIG. 16B is a perspective view of the automatic document feeder 1 when a small number of large-size documents are fed. When the large-size documents are fed, the front side regulation guide 24, the telescopic tray 25, and the telescopic tray cover 28 are integrally pulled out to the pullout position PP on the front side in the width direction WD as shown in FIG. 16A and FIG. 16B. In the pullout position PP, the telescopic tray 25 can support the under surface of the large-size document together with the first upper document tray 21. When the large number of large-size documents are fed, the first upper document tray 21, the front side regulation guide 24, the telescopic tray 25, and the rear side regulation guide 26 are positioned in the lowered position DP as shown in FIG. 16A. In the lowered position DP, the large-size documents are separated from the feeding roller 4. When the small number of large-size documents are fed, the first upper document tray 21, the front side regulation guide 24, the telescopic tray 25, and the rear side regulation guide 26 are integrally raised upward in the stacking direction SD and positioned in the raised position UP as shown in FIG. 16B to enable the large-size documents to be fed. In the raised position UP, the large-size document abuts against the feeding roller 4. The wall portion 286 of the telescopic tray cover 28 covers the air gap V (FIG. 13B) created between the telescopic tray 25 and the telescopic tray cover 28. The wall portion 286 prevents foreign matter from entering through the air gap V and also prevents a user from getting the user's finger caught between the telescopic tray 25 and the telescopic tray cover 28 from the air gap V.

Figure 17A:
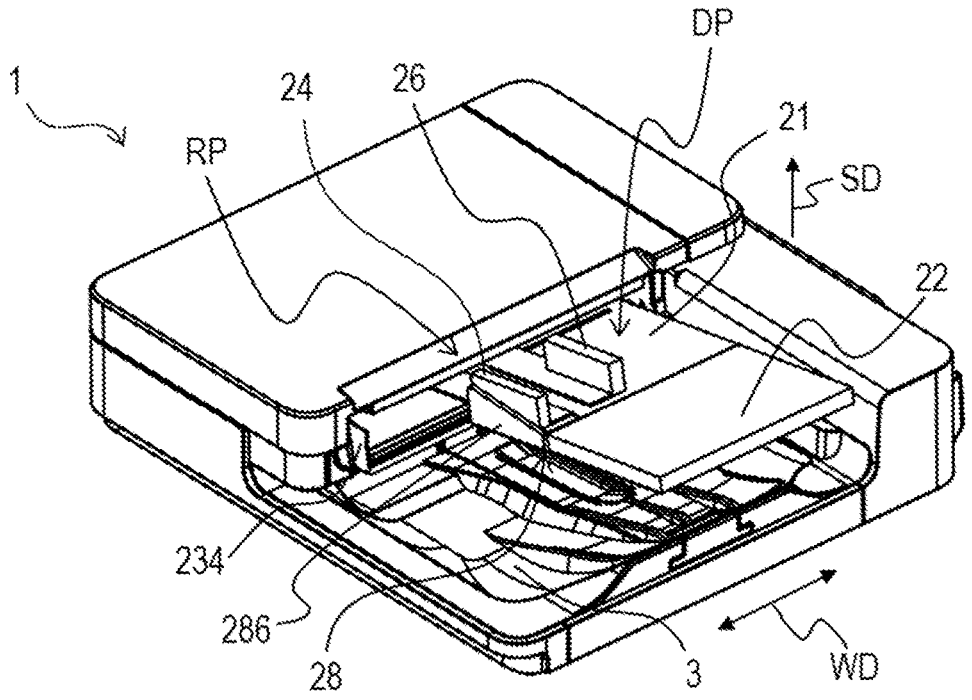
FIG. 17A and FIG. 17B are perspective views of the automatic document feeder in the first embodiment when small-size documents are fed.
Figure 17B:
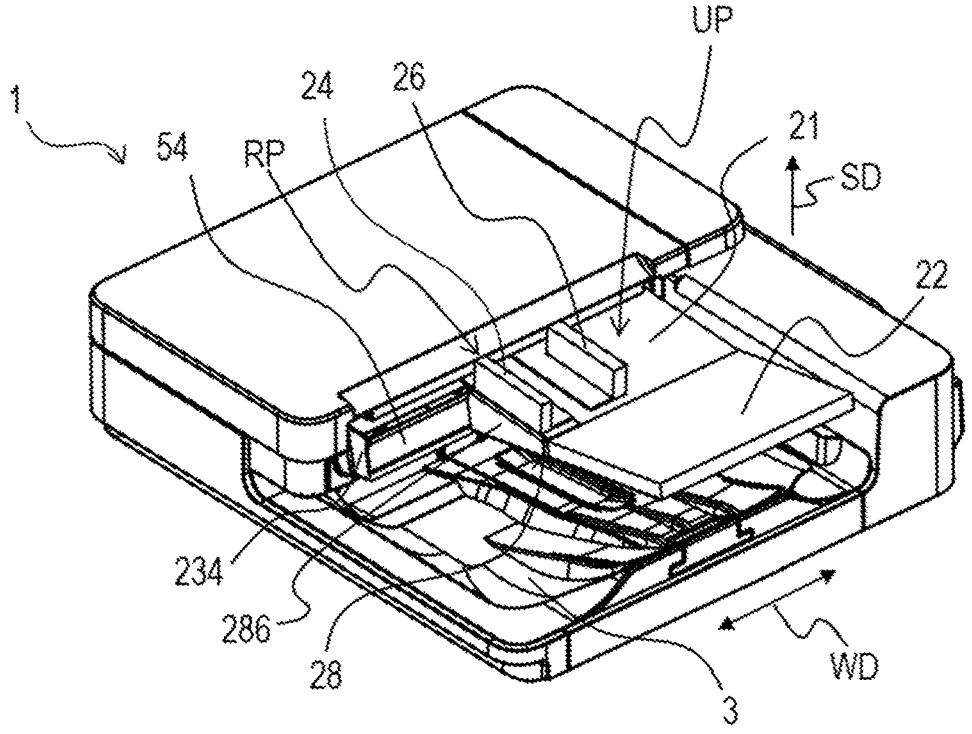

FIG. 17A and FIG. 17B are perspective views of the automatic document feeder 1 in the first embodiment when small-size documents are fed. FIG. 17A is a perspective view of the automatic document feeder 1 when a large number of small-size documents are fed. FIG. 17B is a perspective view of the automatic document feeder 1 when a small number of small-size documents are fed. When the small-size documents are fed, the front side regulation guide 24, the telescopic tray 25, and the telescopic tray cover 28 are integrally retracted to the retracted position RP on the rear side in the width direction WD as shown in FIG. 17A and FIG. 17B. In the retracted position RP, the telescopic tray 25 is retracted below the first upper document tray 21 to expose a portion of the upper surface of the discharge tray 3. This improves the visibility of the small-size documents discharged on the discharge tray 3. When the large number of small-size documents are fed, the first upper document tray 21, the front side regulation guide 24, the telescopic tray 25, and the rear side regulation guide 26 are positioned in the lowered position DP as shown in FIG. 17A. In the lowered position DP, the small-size documents are separated from the feeding roller 4. When the small number of small-size documents are fed, the first upper document tray 21, the front side regulation guide 24, the telescopic tray 25, and the rear side regulation guide 26 are integrally raised upward in the stacking direction SD and positioned in the raised position UP as shown in FIG. 17B to enable the small-size documents to be fed. In the raised position UP, the small-size document abuts against the feeding roller 4. The wall portion 286 of the telescopic tray cover 28 covers the air gap V (FIG. 13B) created between the telescopic tray 25 and the telescopic tray cover 28. The shutter 54 is raised to cover the air gap G (FIG. 15C) created between the first upper document tray 21 and the lower document tray 23. With this, the shutter 54 prevents foreign matter from entering through the air gap G and also prevents a user from getting the user's finger caught between the first upper document tray 21 and the lower document tray 23 from the air gap G.

According to the first embodiment, the shutter 54 is provided to cover the air gap G created between the first upper document tray 21 and the lower document tray 23 when the first upper document tray 21 is moved to the raised position UP in a state in which the telescopic tray 25 is retracted below the first upper document tray 21. Therefore, foreign matter can be prevented from entering the inside of the document stacking device 12 from the air gap G that is created between the first upper document tray 21 and the lower document tray 23. According to the first embodiment, foreign matter can be prevented from entering the inside of the document tray 2.

Second Embodiment

The second embodiment will be described below. In the second embodiment, the same structures as in the first embodiment are denoted by the same reference symbols and the explanations thereof are omitted. Since the image forming apparatus 101 in the second embodiment has the same structure as in the first embodiment, the explanation thereof is omitted. Since the scanner portion 30 of the image reading apparatus 103 in the second embodiment has the same structure as in the first embodiment, the explanation thereof is omitted. The automatic document feeder 1 of the image reading apparatus 103 in the second embodiment has different shutters (first shutter 55 and second shutter 56) from the shutter 54 in the first embodiment. Hereafter, the differences from the first embodiment will be mainly described.

Figure 18A:
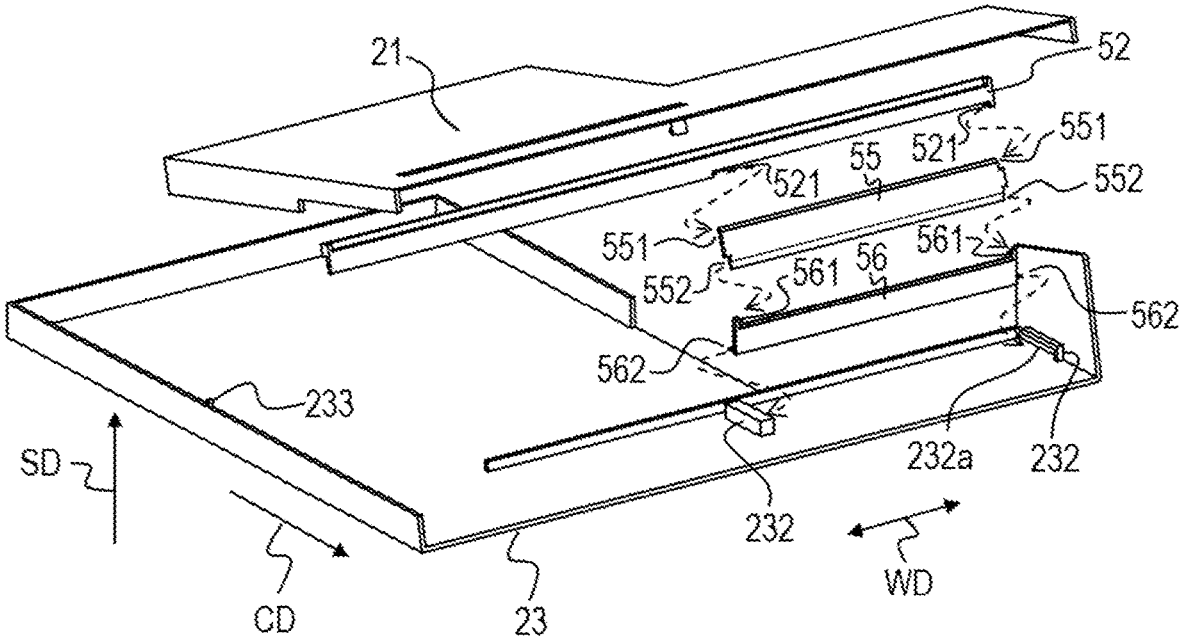
FIG. 18A and FIG. 18B are views of a first upper document tray and a lower document tray in a second embodiment.
Figure 18B:
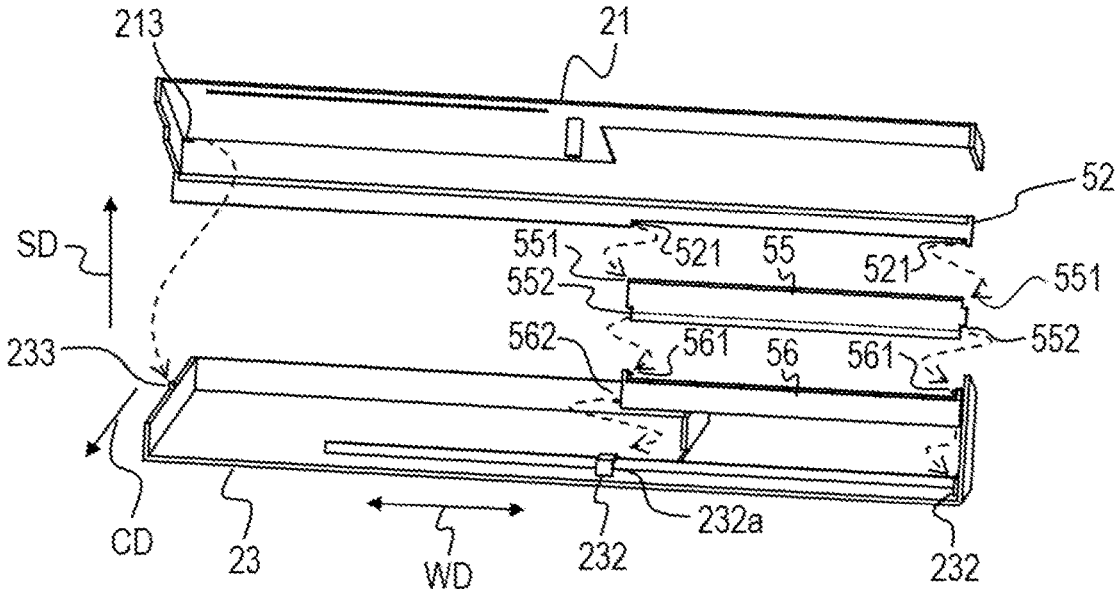

FIG. 18A and FIG. 18B are views of the first upper document tray 21 and the lower document tray 23 in the second embodiment. FIG. 18A is a perspective view of the first upper document tray 21 and the lower document tray 23 before assembly as seen from the left oblique rear side. FIG. 18B is a perspective view of the first upper document tray 21 and the lower document tray 23 before assembly as seen from the left oblique front side. The shutter in the second embodiment includes a first shutter (first cover member) 55 and a second shutter (second cover member) 56. The first shutter 55 is provided with mounting holes 551 in upper portions of both end portions in the longitudinal direction (width direction WD), respectively. Two mounting shafts 521 of the guide member 52 are inserted into the two mounting holes 551 of the first shutter 55, respectively. With this, the guide member 52 rotatably holds the first shutter 55. The first shutter 55 is rotatably connected to the first upper document tray 21 via the guide member 52.

The first shutter 55 is provided with mounting holes 552 in lower portions of both end portions in the longitudinal direction (width direction WD), respectively. The second shutter 56 is provided with mounting shafts 561 on upper portions of both end portions in the longitudinal direction (width direction WD), respectively. The two mounting shafts 561 of the second shutter 56 are inserted into the mounting holes 552 of the first shutter 55, respectively. With this, the first shutter 55 rotatably holds the second shutter 56. The second shutter 56 is provided with mounting shafts (protrusions) 562 on the lower portions (ends on the side of the lower document tray 23) of both end portions in the longitudinal direction (width direction WD), respectively. The two mounting shafts 562 of the second shutter 56 are inserted into groove holes 232*a* in the two guide portions 232 of the lower document tray 23, respectively. With this, the two mounting shafts 562 on the lower end portion of the second shutter 56 are held movably in the feeding direction CD by the groove holes 232*a* in the guide portions 232.

Figure 19A:
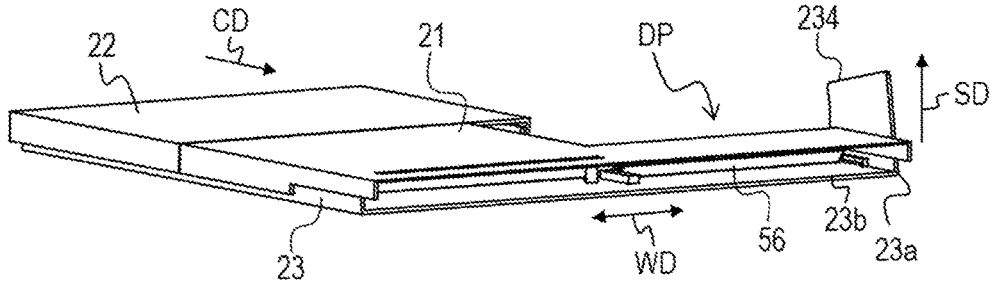
FIG. 19A, FIG. 19B, FIG. 19C, FIG. 19D, and FIG. 19E are explanatory views of the rotation of the first upper document tray with respect to the lower document tray in the second embodiment.
Figure 19B:
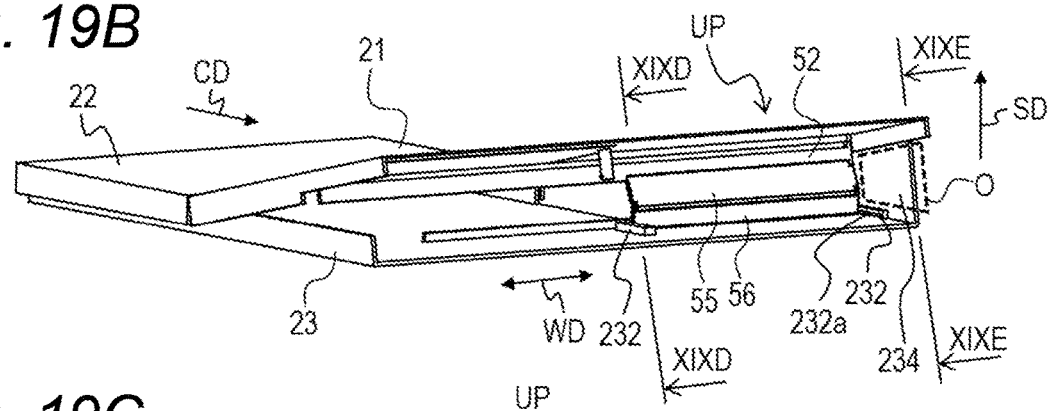
Figure 19C:
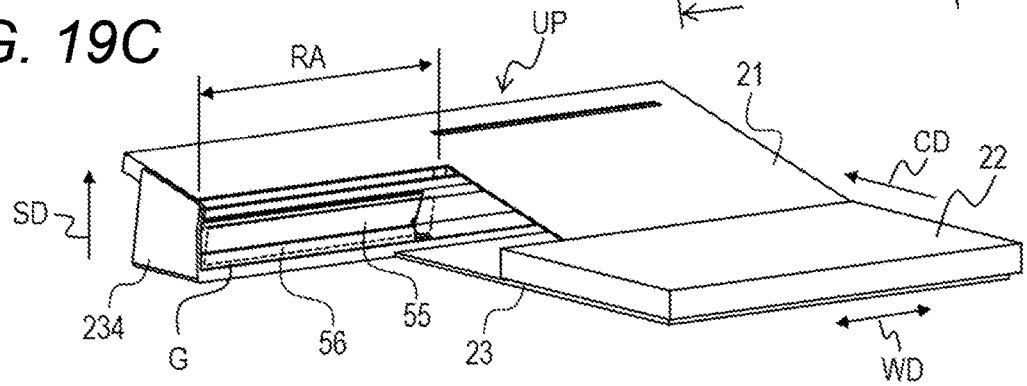

FIG. 19A, FIG. 19B, FIG. 19C, FIG. 19D, and FIG. 19E are explanatory views of the rotation of the first upper document tray 21 with respect to the lower document tray 23 in the second embodiment. FIG. 19A is a perspective view as seen from the left oblique rear side when the first upper document tray 21 is in the lowered position DP without upward rotation. FIG. 19B is a perspective view as seen from the left oblique rear side when the first upper document tray 21 is in the raised position UP with upward rotation. FIG. 19C is a perspective view as seen from the right oblique front side when the first upper document tray 21 is in the raised position UP with upward rotation. As shown in FIG. 19A, when the first upper document tray 21 is in the lowered position DP without upward rotation in the stacking direction SD, the first shutter 55 and the second shutter 56 are stored between the first upper document tray 21 and the lower document tray 23. As shown in FIG. 19B, when the first upper document tray 21 is rotated from the lowered position DP to the raised position UP, the second shutter 56 is rotated and raised in such a manner that the lower end portion of the second shutter 56 is moved along the groove holes 232*a* of the guide portions 232. As the second shutter 56 is raised, the first shutter 55 is also raised. When the first upper document tray 21 is in the raised position UP, the first shutter 55 and the second shutter 56 are exposed between the first upper document tray 21 and the lower document tray 23. At this time, the first shutter 55 and the second shutter 56 cover the air gap G (gap) created between the first upper document tray 21 and the lower document tray 23 on the upstream side in the feeding direction CD within the range RA. That is, the air gap G (gap) is created when the first upper document tray 21, the telescopic tray 25, the front side regulation guide 24, and the rear side regulation guide 26 are in the raised position UP and the front side regulation guide 24 and the telescopic tray 25 are in the retracted position RP. The first shutter 55 and the second shutter 56 cover the air gap G (gap) created between the first upper document tray 21 and the lower document tray 23 on the downstream side of the telescopic tray 25 in the feeding direction CD. In addition, the wall portion 234 provided in the lower document tray 23 covers the air gap 0 (gap) created between the first upper document tray 21 and the lower document tray 23 on the front side in the width direction WD.

Figure 19D:
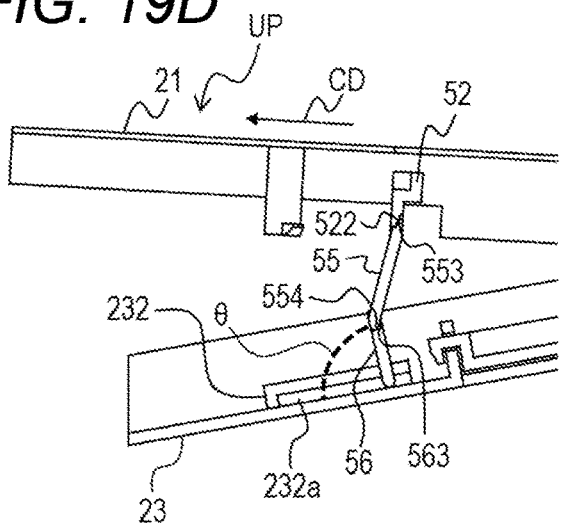
Figure 19E:
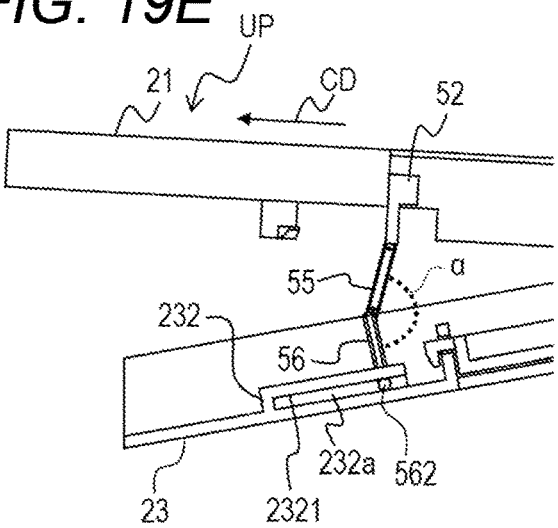

FIG. 19D is a cross-sectional view taken along line XIXD-XIXD in FIG. 19B. FIG. 19E is a cross-sectional view taken along line XIXE-XIXE in FIG. 19B. As shown in FIG. 19D, when the first upper document tray 21 is in the raised position UP, an inclined portion (first abutment portion) 553 provided on the first shutter 55 contacts (abuts) an inclined portion (second abutment portion) 522 provided on the guide member 52. An abutment portion (third abutment portion) 554 provided on the first shutter 55 contacts (abuts) an abutment portion (fourth abutment portion) 563 provided on the second shutter 56. At this time, an angle θ formed by the second shutter 56 and the lower document tray 23 on the downstream side in the feeding direction CD of the document is an acute angle. An angle α formed by the first shutter 55 and the second shutter 56 on the upstream side in the feeding direction CD of the document is an obtuse angle. Therefore, when the first upper document tray 21 is rotated downward in the direction away from the feeding roller 4, the mounting shafts 562 of the second shutter 56 can move in the groove holes 232*a* of the guide portions 232 without resistance, and the first shutter 55 and the second shutter 56 are folded. When the first upper document tray 21 is in the raised position UP as shown in FIG. 19E, the mounting shafts 562 are in contact with the inclined surfaces 2321 of the groove holes 232*a*. Therefore, even if the first shutter 55 and the second shutter 56 receive a force (external force) from the upstream side in the feeding direction CD, the first shutter 55 and the second shutter 56 do not rotate.

Figure 20A:
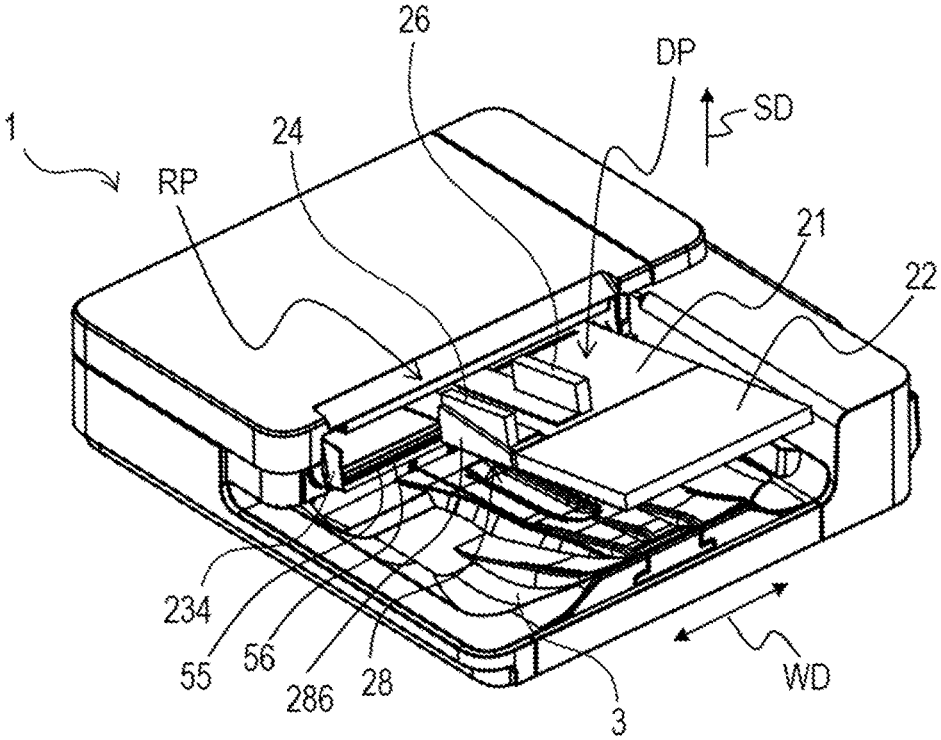
FIG. 20A and FIG. 20B are perspective views of the automatic document feeder in the second embodiment when small-size documents are fed.
Figure 20B:
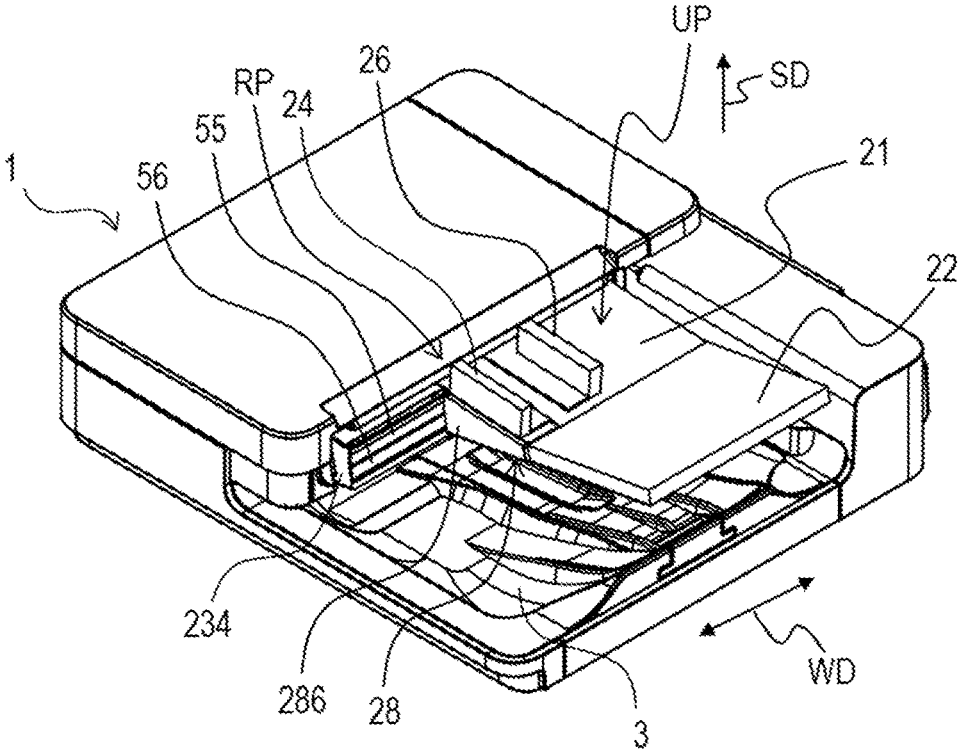

The feeding of large-size documents by the automatic document feeder 1 in the second embodiment is the same as in the first embodiment shown in FIG. 16A and FIG. 16B, so the explanation thereof is omitted. FIG. 20A and FIG. 20B are perspective views of the automatic document feeder 1 in the second embodiment when small-size documents are fed. FIG. 20A is a perspective view of the automatic document feeder 1 in the second embodiment when a large number of small-size documents are fed. FIG. 20B is a perspective view of the automatic document feeder 1 in the second embodiment when a small number of small-size documents are fed. When the small-size documents are fed, the front side regulation guide 24, the telescopic tray 25, and the telescopic tray cover 28 are integrally retracted to the retracted position RP on the rear side in the width direction WD as shown in FIG. 20A and FIG. 20B. In the retracted position RP, the telescopic tray 25 is retracted below the first upper document tray 21 to expose a portion of the upper surface of the discharge tray 3. This improves the visibility of the small-size documents discharged on the discharge tray 3. When the large number of small-size documents are fed, the first upper document tray 21, the front side regulation guide 24, the telescopic tray 25, and the rear side regulation guide 26 are positioned in the lowered position DP as shown in FIG. 20A. In the lowered position DP, the small-size documents are separated from the feeding roller 4. When the small number of small-size documents are fed, the first upper document tray 21, the front side regulation guide 24, the telescopic tray 25, and the rear side regulation guide 26 are integrally raised in the stacking direction SD and positioned in the raised position UP as shown in FIG. 20B to enable the small-size documents to be fed. In the raised position UP, the small-size document abuts against the feeding roller 4. The wall portion 286 of the telescopic tray cover 28 covers the air gap V (FIG. 13B) created between the telescopic tray 25 and the telescopic tray cover 28. The first shutter 55 and the second shutter 56 are raised to cover the air gap G (FIG. 19C) created between the first upper document tray 21 and the lower document tray 23. With this, the first shutter 55 and the second shutter 56 prevent foreign matter from entering from the air gap G and also prevent a user from getting the user's finger caught between the first upper document tray 21 and the lower document tray 23 from the air gap G.

According to the second embodiment, the first shutter 55 and the second shutter 56 are provided to cover the air gap G that is created between the first upper document tray 21 and the lower document tray 23 when the first upper document tray is moved to the raised position UP in a state in which the telescopic tray 25 is retracted below the first upper document tray 21. Therefore, foreign matter can be prevented from entering the inside of the document stacking device 12 from the air gap G that is created between the first upper document tray 21 and the lower document tray 23. According to the second embodiment, foreign matter can be prevented from entering the document tray 2.

In the first embodiment and the second embodiment, the upper document tray has the first upper document tray 21 and the second upper document tray 22. However, the upper document tray may be a single tray, and the single tray may be held rotatably relative to the lower document tray 23.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2022-077459, filed May 10, 2022, which is hereby incorporated by reference herein in its entirety.

What is claimed is:

1. A document conveying apparatus, comprising:

a document tray on which a document is placed;

a feeding member configured to feed the document placed on the document tray in a feeding direction;

a conveying portion configured to convey the document fed by the feeding member; and a discharge tray which is disposed below the document tray and onto which the document conveyed by the conveying portion is discharged, wherein the document tray includes an upper tray member configured to support the document, a lower tray member disposed to cover an underside of the upper tray member, a movable tray member configured to move, with respect to the upper tray member, in a width direction orthogonal to the feeding direction between a first position in which the movable tray member supports the document together with the upper tray member and a second position in which the movable tray member is retracted from the first position into below the upper tray member, a first regulating member provided on the movable tray member and configured to regulate one side edge of the document supported by the document tray in the width direction, a second regulating member provided on the upper tray member and configured to regulate the other side edge of the document supported by the document tray in the width direction, and a driving portion configured to move the upper tray member and the movable tray member integrally to a raised position in which the document placed on the document tray contacts the feeding member and a lowered position in which the document placed on the document tray is separated from the feeding member, wherein the document tray includes a shutter configured to cover a gap created between the upper tray member and the lower tray member, the gap being created by the upper tray member and the movable tray member being moved from the lowered position to the raised position and the movable tray member being moved from the first position to the second position.

2. The document conveying apparatus according to claim 1, wherein the shutter is rotatably connected to the upper tray member.

3. The document conveying apparatus according to claim 1, wherein the shutter has a protrusion at an end of the shutter on a side of the lower tray member, and wherein the lower tray member has a groove portion configured to guide the protrusion.

4. The document conveying apparatus according to claim 3, wherein the groove portion is provided with a regulating surface configured to contact the protrusion so as to regulate the shutter from being rotated by an external force when the upper tray member and the movable tray member are in the raised position.

5. The document conveying apparatus according to claim 1, wherein when the upper tray member and the movable tray member are in the raised position, an angle formed by the shutter and the lower tray member on an upstream side in the feeding direction is an acute angle.

6. The document conveying apparatus according to claim 1, wherein when the upper tray member and the movable tray member are in the raised position, a first abutment portion provided on the shutter abuts against a second abutment portion provided on the upper tray member.

7. The document conveying apparatus according to claim 1, wherein the shutter has a first shutter member rotatably connected to the upper tray member and a second shutter member rotatably connected to the first shutter member.

8. The document conveying apparatus according to claim 7, wherein the second shutter member has a protrusion at an end of the second shutter member on a side of the lower tray member, and wherein the lower tray member is provided with a groove portion configured to guide the protrusion.

9. The document conveying apparatus according to claim 8, wherein the groove portion is provided with a regulating surface configured to contact the protrusion so as to regulate the second shutter member from being rotated by an external force when the upper tray member and the movable tray member are in the raised position.

10. The document conveying apparatus according to claim 7, wherein when the upper tray member and the movable tray member are in the raised position, an angle formed by the second shutter member and the lower tray member on a downstream side of the feeding direction is an acute angle.

11. The document conveying apparatus according to claim 7, wherein when the upper tray member and the movable tray member are in the raised position, an angle formed by the first shutter member and the second shutter member on an upstream side of the feeding direction is an obtuse angle.

12. The document conveying apparatus according to claim 7, wherein when the upper tray member and the movable tray member are in the raised position, a first abutment portion provided on the first shutter member abuts against a second abutment portion provided on the upper tray member, and a third abutment portion provided on the first shutter member abuts against a fourth abutment portion provided on the second shutter member.

13. The document conveying apparatus according to claim 1, wherein the document tray includes a tray cover disposed to cover an underside of the movable tray member and movable in the width direction integrally with the movable tray member.

14. An image reading apparatus comprising:

a document conveying apparatus, including a document tray on which a document is placed, a feeding member configured to feed the document placed on the document tray in a feeding direction, a conveying portion configured to convey the document fed by the feeding member, and a discharge tray which is disposed below the document tray and onto which the document conveyed by the conveying portion is discharged, wherein the document tray includes an upper tray member configured to support the document, a lower tray member disposed to cover an underside of the upper tray member, a movable tray member configured to move, with respect to the upper tray member, in a width direction orthogonal to the feeding direction between a first position in which the movable tray member supports the document together with the upper tray member and a second position in which the movable tray member is retracted from the first position into below the upper tray member, a first regulating member provided on the movable tray member and configured to regulate one side edge of the document supported by the document tray in the width direction, a second regulating member provided on the upper tray member and configured to regulate the other side edge of the document supported by the document tray in the width direction, and a driving portion configured to move the upper tray member and the movable tray member integrally to a raised position in which the document placed on the document tray contacts the feeding member and a lowered position in which the document placed on the document tray is separated from the feeding member, wherein the document tray includes a shutter configured to cover a gap created between the upper tray member and the lower tray member, the gap being created by the upper tray member and the movable tray member being moved from the lowered position to the raised position and the movable tray member being moved from the first position to the second position; and an image reading portion configured to read an image of the document conveyed by the document conveying apparatus.

15. An image forming apparatus comprising:

an image reading apparatus including a document conveying apparatus, including a document tray on which a document is placed, a feeding member configured to feed the document placed on the document tray in a feeding direction, a conveying portion configured to convey the document fed by the feeding member, and a discharge tray which is disposed below the document tray and onto which the document conveyed by the conveying portion is discharged, wherein the document tray includes an upper tray member configured to support the document, a lower tray member disposed to cover an underside of the upper tray member, a movable tray member configured to move, with respect to the upper tray member, in a width direction orthogonal to the feeding direction between a first position in which the movable tray member supports the document together with the upper tray member and a second position in which the movable tray member is retracted from the first position into below the upper tray member, a first regulating member provided on the movable tray member and configured to regulate one side edge of the document supported by the document tray in the width direction, a second regulating member provided on the upper tray member and configured to regulate the other side edge of the document supported by the document tray in the width direction, and a driving portion configured to move the upper tray member and the movable tray member integrally to a raised position in which the document placed on the document tray contacts the feeding member and a lowered position in which the document placed on the document tray is separated from the feeding member, wherein the document tray includes a shutter configured to cover a gap created between the upper tray member and the lower tray member, the gap being created by the upper tray member and the movable tray member being moved from the lowered position to the raised position and the movable tray member being moved from the first position to the second position, and an image reading portion configured to read an image of the document conveyed by the document conveying apparatus; and an image forming portion configured to form the image of the document read by the image reading apparatus on a recording medium.

* * * * *